US009601127B2

(12) United States Patent
Yang et al.

(10) Patent No.: US 9,601,127 B2
(45) Date of Patent: Mar. 21, 2017

(54) SOCIAL MUSIC SYSTEM AND METHOD WITH CONTINUOUS, REAL-TIME PITCH CORRECTION OF VOCAL PERFORMANCE AND DRY VOCAL CAPTURE FOR SUBSEQUENT RE-RENDERING BASED ON SELECTIVELY APPLICABLE VOCAL EFFECT(S) SCHEDULE(S)

(71) Applicant: Smule, Inc., Palo Alto, CA (US)

(72) Inventors: Jeannie Yang, San Francisco, CA (US); Nicholas M. Kruge, San Francisco, CA (US); Gregory C. Thompson, San Francisco, CA (US); Perry R. Cook, Jacksonville, OR (US)

(73) Assignee: Smule, Inc., San Francisco, CA (US)

( * ) Notice: Subject to any disclaimer, the term of this patent is extended or adjusted under 35 U.S.C. 154(b) by 120 days.

(21) Appl. No.: 13/960,564

(22) Filed: Aug. 6, 2013

(65) Prior Publication Data

US 2014/0039883 A1 Feb. 6, 2014

Related U.S. Application Data

(63) Continuation-in-part of application No. 13/085,414, filed on Apr. 12, 2011, now Pat. No. 8,983,829.

(60) Provisional application No. 61/680,652, filed on Aug. 7, 2012, provisional application No. 61/323,348, filed on Apr. 12, 2010.

(51) Int. Cl.

| | |
|---|---|
| ***G10L 21/00*** | (2013.01) |
| ***G10L 21/013*** | (2013.01) |
| ***G10H 1/36*** | (2006.01) |

(52) U.S. Cl.
CPC ..... *G10L 21/013* (2013.01); *G10H 1/366* (2013.01); *G10H 2210/066* (2013.01); *G10H 2210/331* (2013.01); *G10H 2240/251* (2013.01)

(58) Field of Classification Search
CPC ..... G10L 21/00; G10L 21/003; G10L 21/013; G10H 1/366
USPC ..... 704/207
See application file for complete search history.

(56) References Cited

U.S. PATENT DOCUMENTS

| | | | | |
|---|---|---|---|---|
| 5,641,927 | A * | 6/1997 | Pawate et al. | 84/609 |
| 5,753,845 | A * | 5/1998 | Nagata et al. | 84/626 |
| 5,889,223 | A * | 3/1999 | Matsumoto | 84/609 |

(Continued)

*Primary Examiner* — Jialong He
(74) *Attorney, Agent, or Firm* — Haynes and Boone, LLP

(57) ABSTRACT

Vocal musical performances may be captured and, in some cases or embodiments, pitch-corrected and/or processed in accord with a user selectable vocal effects schedule for mixing and rendering with backing tracks in ways that create compelling user experiences. In some cases, the vocal performances of individual users are captured on mobile devices in the context of a karaoke-style presentation of lyrics in correspondence with audible renderings of a backing track. Such performances can be pitch-corrected in real-time at the mobile device in accord with pitch correction settings. Vocal effects schedules may also be selectively applied to such performances. In these ways, even amateur user/performers with imperfect pitch are encouraged to take a shot at "stardom" and/or take part in a game play, social network or vocal achievement application architecture that facilitates musical collaboration on a global scale and/or, in some cases or embodiments, to initiate revenue generating in-application transactions.

49 Claims, 7 Drawing Sheets

(56) References Cited

U.S. PATENT DOCUMENTS

| | | | | |
|---|---|---|---|---|
| 5,974,154 | A * | 10/1999 | Nagata et al. | 381/63 |
| 6,336,092 | B1 * | 1/2002 | Gibson et al. | 704/268 |
| 6,353,174 | B1 * | 3/2002 | Schmidt et al. | 84/609 |
| 7,129,408 | B2 * | 10/2006 | Uehara | 84/645 |
| 7,297,858 | B2 * | 11/2007 | Paepcke | 84/609 |
| 7,853,342 | B2 * | 12/2010 | Redmann | 700/94 |
| 2002/0091847 | A1 * | 7/2002 | Curtin | 709/231 |
| 2003/0055646 | A1 * | 3/2003 | Yoshioka et al. | 704/258 |
| 2003/0099347 | A1 * | 5/2003 | Ford et al. | 379/387.01 |
| 2003/0100965 | A1 * | 5/2003 | Sitrick et al. | 700/83 |
| 2003/0164084 | A1 * | 9/2003 | Redmann et al. | 84/615 |
| 2005/0120865 | A1 * | 6/2005 | Tada | 84/600 |
| 2005/0182504 | A1 * | 8/2005 | Bailey | 700/94 |
| 2005/0255914 | A1 * | 11/2005 | McHale | A63F 13/10 463/31 |
| 2006/0165240 | A1 * | 7/2006 | Bloom et al. | 381/56 |
| 2007/0028750 | A1 * | 2/2007 | Darcie et al. | 84/625 |
| 2007/0098368 | A1 * | 5/2007 | Carley et al. | 386/96 |
| 2007/0287141 | A1 * | 12/2007 | Milner | 434/307 A |
| 2008/0190271 | A1 * | 8/2008 | Taub et al. | 84/645 |
| 2009/0165634 | A1 * | 7/2009 | Mahowald | 84/610 |
| 2010/0014692 | A1 | 1/2010 | Schreiner et al. | |
| 2010/0087240 | A1 * | 4/2010 | Egozy et al. | 463/7 |
| 2010/0192753 | A1 * | 8/2010 | Gao et al. | 84/610 |
| 2010/0326256 | A1 * | 12/2010 | Emmerson | 84/610 |
| 2011/0004467 | A1 | 1/2011 | Taub et al. | |
| 2011/0126103 | A1 * | 5/2011 | Cohen et al. | 715/716 |
| 2011/0144982 | A1 | 6/2011 | Salazar et al. | |
| 2011/0251842 | A1 | 10/2011 | Cook et al. | |
| 2012/0089390 | A1 | 4/2012 | Yang et al. | |

* cited by examiner

SOCIAL MUSIC SYSTEM AND METHOD WITH CONTINUOUS, REAL-TIME PITCH CORRECTION OF VOCAL PERFORMANCE AND DRY VOCAL CAPTURE FOR SUBSEQUENT RE-RENDERING BASED ON SELECTIVELY APPLICABLE VOCAL EFFECT(S) SCHEDULE(S)

CROSS-REFERENCE TO RELATED APPLICATION(S)

The present application claims priority of U.S. Provisional Application No. 61/680,652, filed Aug. 7, 2012 and is a continuation-in-part of commonly-owned, co-pending U.S. patent application Ser. No. 13/085,414, filed Apr. 12, 2011, entitled "COORDINATING AND MIXING VOCALS CAPTURED FROM GEOGRAPHICALLY DISTRIBUTED PERFORMERS" and naming Cook, Lazier, Lieber and Kirk as inventors, which in turn claims priority of U.S. Provisional Application No. 61/323,348, filed Apr. 12, 2010. Each of the aforementioned applications is incorporated by reference herein.

BACKGROUND

Field of the Invention

The invention(s) relates (relate) generally to capture and/or processing of vocal performances and, in particular, to techniques suitable for selectively applying vocal effects schedules to captured vocals.

Description of the Related Art

The installed base of mobile phones and other portable computing devices grows in sheer number and computational power each day. Hyper-ubiquitous and deeply entrenched in the lifestyles of people around the world, they transcend nearly every cultural and economic barrier. Computationally, the mobile phones of today offer speed and storage capabilities comparable to desktop computers from less than ten years ago, rendering them surprisingly suitable for real-time sound synthesis and other musical applications. Partly as a result, some modern mobile phones, such as the iPhone® handheld digital device, available from Apple Inc., support audio and video playback quite capably.

Like traditional acoustic instruments, mobile phones can be intimate sound producing devices. However, by comparison to most traditional instruments, they are somewhat limited in acoustic bandwidth and power. Nonetheless, despite these disadvantages, mobile phones do have the advantages of ubiquity, strength in numbers, and ultramobility, making it feasible to (at least in theory) bring together artists for jam sessions, rehearsals, and even performance almost anywhere, anytime. The field of mobile music has been explored in several developing bodies of research. See generally, G. Wang, *Designing Smule's iPhone Ocarina*, presented at the 2009 on New Interfaces for Musical Expression, Pittsburgh (June 2009). Moreover, experience with applications such as the Ocarina™, Leaf Trombone: World Stage™, and I Am T-Pain™ applications available from Smule, Inc. for iPhone®, iPad®, iPod Touch® and other iOS®devices has shown that advanced digital acoustic techniques may be delivered in ways that provide a compelling user experience. iPhone, iPad, iPod Touch are trademarks of Apple, Inc. iOS is a trademark of Cisco Technology, Inc. used by Apple under license.

As digital acoustic researchers seek to transition their innovations to commercial applications deployable to modern handheld devices such as the iPhone® handheld and other platforms operable within the real-world constraints imposed by processor, memory and other limited computational resources thereof and/or within communications bandwidth and transmission latency constraints typical of wireless networks, significant practical challenges present. Improved techniques, functional capabilities and user experiences are desired.

SUMMARY

It has been discovered that, despite many practical limitations imposed by mobile device platforms and application execution environments, vocal musical performances may be captured and, in some cases or embodiments, pitch-corrected and/or processed in accord with a user selectable vocal effects schedule for mixing and rendering with backing tracks in ways that create compelling user experiences. In some cases, the vocal performances of individual users are captured on mobile devices in the context of a karaoke-style presentation of lyrics in correspondence with audible renderings of a backing track. Such performances can be pitch-corrected in real-time at the mobile device (or more generally, at a portable computing device such as a mobile phone, personal digital assistant, laptop computer, notebook computer, pad-type computer or net book) in accord with pitch correction settings. Vocal effects schedules may also be selectively applied to such performances. In this way, even amateur user/performers with imperfect pitch are encouraged to take a shot at "stardom" and/or take part in a game play, social network or vocal achievement application architecture that facilitates musical collaboration on a global scale and/or, in some cases or embodiments, to initiate revenue generating in-application transactions.

In some cases or embodiments, such transactions may include purchase or license of a computer readable encoding of artist-, song-, and/or performance-characteristic vocal effects schedule that may be selectively applied to captured vocals. In some cases or embodiments, the vocal effects schedule is specific to a musical genre. In some cases or embodiments, transactions may include purchase or license of a computer readable encoding of lyrics, timing and/or pitch correction settings or plug-ins. In some cases or embodiments, transactions may include purchase of "do overs" or retakes for all or a portion of a vocal performance. In some cases or embodiments, in addition to (or in lieu of) in-application purchase-type transactions, access to computer readable encodings of vocal effects schedules, lyrics, timing, pitch correction settings and/or retakes may be earned in accord with vocal achievement (e.g., based on pitch, timing or other correspondence with a target score or other vocal performance) or based on successful traversal of game play logic.

As with vocal effects schedule transactions, social interactions mediated by an application or social network infrastructure, such as forming groups, joining groups, sharing performances, initiating an open call, etc. generate an applicable currency or credits for transactions involving "do over" or retake entitlements. In some cases, user viewing of advertising content may generate the applicable currency or credits for such transactions.

In some cases or embodiments, pitch correction settings code a particular key or scale for the vocal performance or for portions thereof. In some cases or embodiments, pitch correction settings include a score-coded melody and/or harmony sequence supplied with, or for association with, the lyrics and backing tracks. Harmony notes or chords may be coded as explicit targets or relative to the score coded melody or even actual pitches sounded by a vocalist, if desired. In some cases or embodiments, vocal effects schedules and/or pitch correction settings supplied with, or for association with, the lyrics and backing tracks may pertain to only a portion of a coordinated vocal performance (e.g., to lead vocals, backup singer vocals, a chorus or refrain, a portion of a duet or three part harmony, etc.)

In these various ways, user performances (typically those of amateur vocalists) can be significantly improved in tonal or performance quality, the user can be provided with immediate and encouraging feedback and, in some cases or embodiments, the user can emulate or take on the persona or style of a favorite artist, iconic performance or musical genre. Typically, feedback may include both the pitch-corrected vocals themselves and visual reinforcement (during vocal capture) when the user/vocalist is "hitting" the (or a) correct note. In general, "correct" notes are those notes that are consistent with a key and which correspond to a score-coded melody or harmony expected in accord with a particular point in the performance. That said, in a capella modes without an operant score and to facilitate ad-libbing off score or with certain pitch correction settings disabled, pitches sounded in a given vocal performance may be optionally corrected solely to nearest notes of a particular key or scale (e.g., C major, C minor, E flat major, etc.) In each case, vocal sounding of "correct" notes may earn a user-vocalist points (e.g., in a game play sequence) and/or credits (e.g., in an in-application transaction framework). In general, such points or credits may be applied (using transaction handling logic implemented, in part, at the handheld device) to purchase or license of additional vocal scores and lyrics, of additional artist-, song-, performance-, or musical genre-specific vocal effects schedules, or even of vocal capture "redos" for a user selectable portion of a previously captured vocal performance.

Based on the compelling and transformative nature of pitch-corrected vocals and of artist-, song-, performance-, or musical genre-specific vocal effects, user/vocalists may overcome an otherwise natural shyness or angst associated with sharing their vocal performances. Instead, even mere amateurs are encouraged to share with friends and family or to collaborate and contribute vocal performances as part of virtual "glee clubs" or "open calls." In some implementations, these interactions are facilitated through social network- and/or eMail-mediated sharing of performances and invitations to join in a group performance. Using uploaded vocals captured at clients such as the aforementioned portable computing devices, a content server (or service) can mediate such virtual glee clubs or open calls by manipulating and mixing the uploaded vocal performances of multiple contributing vocalists. Depending on the goals and implementation of a particular system, uploads may include (i) dry vocals versions of user's captured vocal performance suitable for application (re-application) of a vocal effects schedule and/or pitch-correction, (ii) pitch-corrected vocal performances (with or without harmonies), and/or (iii) control tracks or other indications of user key, pitch correction and/or vocal effects schedule selections, etc. By including dry vocals in the upload, significant flexibility is afforded for post-processing (at a content server or service) with selectable vocal effects schedule and for mixing, cross-fading and/or pitch shifting of respective vocal contributions into appropriate score or performance template slotting or position.

Virtual glee clubs or open calls can be mediated in any of a variety of ways. For example, in some cases or embodiments, a first user's vocal performance, captured against a backing track at a portable computing device (and pitch-corrected in accord with score-coded melody and/or harmony cues for the benefit of the performing user vocalist), is supplied to other potential vocal performers via a content server or service. Typically, the captured vocal performance is supplied as dry vocals with, or in an encoding form associable with, pitch-correction and/or vocal effect schedule settings or selections. A vocal effects schedule may be selectively applied (the content server or service or, optionally at the portable computing device) to the supplied vocal performance (or portions thereof) and the result is mixed with backing instrumentals/vocals to form a second-generation backing track against which a second user's vocals may be captured.

In some cases, successive vocal contributors are geographically separated and may be unknown (at least a priori) to each other, yet the intimacy of the vocals together with the collaborative experience itself tends to minimize this physical separation. In other cases, an open call may be posted to a group of potential contributors selected by, or otherwise associable with, the initiating user-vocalist. As successive vocal performances are captured (e.g., at respective portable computing devices) and accreted as part of the virtual glee club or in response to an open call, the backing track against which respective vocals are captured may evolve to include previously captured vocals of other "members" or open call respondents. In some cases, storing or maintaining dry vocals versions of the captured vocal performances may facilitate application of changeable (or later selectable) vocal effects schedules.

Depending on the goals and implementation of a particular system, the vocal effects (EFX) schedule may include (in a computer readable media encoding) settings and/or parameters for one or more of spectral equalization, audio compression, pitch correction, stereo delay, and reverberation effects for application to one or more respective portions of the user's vocal performance. In some cases or embodiments, a vocal effects schedule may be characteristic of an artist, song or performance and may be applied to an audio encoding of the user's captured vocal performance to cause a derivative audio encoding or audible rendering to take on characteristics of the selected artist, song or performance.

It will be understood, that in the context of the present disclosure, the term vocal effects schedule is meant to encompass, in at least some cases or embodiments, an enumerated and operant set of vocal EFX to be applied to some or all of a captured (typically, dry vocals version of a) vocal performance. Thus, differing vocal effects schedules may be earned or transacted and applied to captured dry vocals to provide a "Katy Perry effect" or a "T-Pain effect." In some cases, social interactions mediated by an application or social network infrastructure, such as forming groups, joining groups, sharing performances, initiating an open call, etc. generate an applicable currency or credits for such transactions. In some cases, user viewing of advertising content may generate the applicable currency or credits for such transactions.

In some cases, differing vocal effects schedules may be applied to a user's captured dry vocals to imbue a derivative audio encoding of audible rendering with studio or "live" performance characteristics of a particular artist or song. In at least some cases or embodiments, the term vocal effects schedule may further encompass, an enumerated set of vocal EFX that varies in temporal or template correspondence with portions of a vocal score (e.g., with distinct vocal EFX sets for pre-chorus and chorus portions of a song and/or with distinct vocal effects sets for respective portions of a duet or other multi-vocalist performance). Likewise, respective portions of a single vocal effects schedule (or for that matter, a pair of distinct vocal effects schedules) may be employed relative to respective vocal performance captures to provide appropriate and respective EFX for a vocal performance capture of a first portion of a duet performed by a first user and for a separate vocal performance capture of a second portion of a duet performed by a second user.

In some cases or embodiments, captivating visual animations and/or facilities for listener comment and ranking, as well as open call management or vocal performance accretion logic are provided in association with an audible rendering of a vocal performance (e.g., that captured at another similarly configured mobile device) mixed with backing instrumentals and/or vocals. Synthesized harmonies and/or additional vocals (e.g., vocals captured from another vocalist at still other locations and optionally pitch-shifted to harmonize with other vocals) may also be included in the mix. Geocoding of captured vocal performances (or individual contributions to a combined performance) and/or listener feedback may facilitate animations or display artifacts in ways that are suggestive of a performance or endorsement emanating from a particular geographic locale on a user manipulable globe. In this way, implementations of the described functionality can transform otherwise mundane mobile devices into social instruments that foster a unique sense of global connectivity, collaboration and community.

In some embodiments of the present invention, a method includes using a portable computing device for vocal performance capture, the portable computing device having a touch screen, a microphone interface and a communications interface. The method includes, responsive to a user selection on the touch screen, retrieving via the communications interface, a vocal score temporally synchronized with a corresponding backing track and lyrics, the vocal score encoding a sequence of target notes for at least part of a vocal performance against the backing track. At the portable computing device, the backing track is audibly rendered and corresponding portions of the lyrics are concurrently presented on a display in temporal correspondence therewith. In temporal correspondence with the backing track, a vocal performance of the user is captured via the microphone interface, and a dry vocals version of the user's captured vocal performance is stored at the portable computing device. In accord with the vocal score, the portable computing device performs continuous, real-time pitch shifting of at least some portions of the user's captured vocal performance and mixes the resulting pitch-shifted vocal performance of the user into the audible rendering of the backing track.

In some embodiments, the method further includes applying at least one vocal effects schedule to the user's captured vocal performance. The vocal effects schedule includes a computer readable encoding of settings and/or parameters for one or more of spectral equalization, audio compression, pitch correction, stereo delay, and reverberation effects, for application to one or more respective portions of the user's vocal performance. In some cases, the vocal effects schedule codes differing effects for application to respective portions of the user's vocal performance in temporal correspondence with the backing track or lyrics. In some cases, the vocal effects schedule is characteristic of a particular artist, song or performance.

In some embodiments, the method further includes transacting from the portable computing device a purchase or license of at least a portion of the vocal effects schedule. In some embodiments, the method includes, in furtherance of the transacting, retrieving via the communications interface, or unlocking a preexisting stored instance of, a computer readable encoding of the vocal effects schedule. In some embodiments, the method further computationally evaluating correspondence of at least a portion of the user's captured vocal performance with the vocal score and, based on a threshold figure of merit, awarding the user a license or access to at least a portion of the vocal effects schedule.

In some cases, the vocal effects schedule is subsequently applied to the dry vocals version of the user's captured vocal performance. In some cases, the subsequent application to the dry vocals is at the portable device and the method further includes audibly re-rendering at the portable device the user's captured vocal performance with pitch shifting and vocal effects applied. In some embodiments, the method includes transmitting to a remote service or server, via the communications interface, an audio signal encoding of the dry vocals version of the user's captured vocal performance for the subsequent application, at the remote service or server, of the vocal effects schedule.

In some embodiments, the method further includes transmitting in, or for, association with the transmitted audio signal encoding of the dry vocals, an open call indication that the user's captured vocal performance constitutes but one of plural vocal performances to be combined at the remote service or server. In some cases, the open call indication directs the remote service or server to solicit from one or more other vocalists the additional one or more vocal performances to be mixed for audible rendering with that of the user. In some cases, the solicitation is directed to (i) an enumerated set of potential other vocalists specified by the user, (ii) members of an affinity group defined or recognized by the remote service or server, or (iii) a set of social network relations of the user. In some cases, the open call indication specifies for at least one additional vocalist position, a second vocal score and second lyrics for supply to a responding additional vocalist. In some cases, the open call indication further specifies for the at least one additional vocalist position, a second vocal effects schedule for application to the vocal performance of the responding additional vocalist.

In some embodiments, the method further includes receiving from the remote service or server a version of the user's captured vocal performance processed in accordance with the vocal effects schedule and audibly re-rendering at the portable device the user's captured vocal performance with vocal effects applied.

In some cases, the vocal effects schedule is applied at the portable computing device in a rendering pipeline that includes the continuous, real-time pitch shifting such that the audible rendering includes the scheduled vocal effects.

In some embodiments, the method includes transacting from the portable computing device an entitlement to initiate vocal recapture of a user selected portion of the previously captured vocal performance. In some embodiments, the method includes computationally evaluating correspondence of at least a portion of the user's captured vocal performance with the vocal score and based on a threshold figure of merit, according the user an entitlement to initiate vocal recapture of a user selected portion of the previously captured vocal performance.

In some cases, wherein the pitch shifting is based on continuous time-domain estimation of pitch for the user's captured vocal performance. In some cases, the continuous time-domain pitch estimation includes computing, for a current block of a sampled signal corresponding to the user's captured vocal performance, a lag-domain periodogram, the lag-domain periodogram computation includes, for an analysis window of the sampled signal, evaluation of an average magnitude difference function (AMDF) or an autocorrelation function for a range of lags.

In some embodiments, the method includes, responsive to the user selection, also retrieving the backing track via the data communications interface. In some cases, the backing track resides in storage local to the portable computing device, and the retrieving identifies the vocal score temporally synchronizable with the corresponding backing track and lyrics using an identifier ascertainable from the locally stored backing track. In some cases, the backing track includes either or both of instrumentals and backing vocals and is rendered in multiple versions, wherein the version of the backing track audibly rendered in correspondence with the lyrics is a monophonic scratch version, and the version of the backing track mixed with pitch-corrected vocal versions of the user's vocal performance is a polyphonic version of higher quality or fidelity than the scratch version.

In some embodiments, the portable computing device is selected from the group of a mobile phone, a personal digital assistant, a media player or gaming device, and a laptop computer, notebook computer, tablet computer or net book. In some embodiments, the display includes the touch screen. In some embodiments, the display is wirelessly coupled to the portable computing device.

In some embodiments, the method includes geocoding the transmitted audio signal encoding of the dry vocals. In some embodiments, the method further includes receiving from the remote service or server via the communications interface an audio signal encoding that includes a second vocal performance captured at a remote device and displaying a geographic origin for the second vocal performance in correspondence with an audible rendering that includes the second vocal performance. In some cases, the display of geographic origin is by display animation suggestive of a performance emanating from a particular location on a globe.

In some embodiments in accordance with the present invention(s), a method includes (i) using a portable computing device for vocal performance capture, the portable computing device having a touch screen, a microphone interface and a communications interface; (ii) responsive to a user selection on the touch screen, retrieving via the communications interface, a vocal score temporally synchronized with a corresponding backing track and lyrics, the vocal score encoding a sequence of target notes for at least part of a vocal performance against the backing track; (iii) at the portable computing device, audibly rendering the backing track and concurrently presenting corresponding portions of the lyrics on a display in temporal correspondence therewith; (iv) capturing via the microphone interface, and in temporal correspondence with the backing track, a vocal performance of the user; and (v) transmitting to a remote service or server, via the communications interface, an audio signal encoding of a dry vocals version of the user's captured vocal performance together with a selection of at least one vocal effects schedule to be applied the user's captured vocal performance.

In some embodiments, the method further includes applying, at the remote service or server, of the selected vocal effects schedule. In some embodiments, the method further includes performing, at the portable computing device and in accord with the vocal score, continuous, real-time pitch shifting of at least some portions of the user's captured vocal performance and mixing the resulting pitch-shifted vocal performance of the user into the audible rendering of the backing track.

In some cases, the selected vocal effects schedule includes a computer readable encoding of settings and/or parameters for one or more of spectral equalization, audio compression, pitch correction, stereo delay, and reverberation effects for application to one or more respective portions of the user's vocal performance. In some cases, the vocal effects schedule is specific to a musical genre. In some cases, the vocal effects schedule is characteristic of a particular artist, song or performance.

In some embodiments, the method includes transacting from the portable computing device a purchase or license of at least a portion of the vocal effects schedule. In some embodiments, the method includes computationally evaluating correspondence of at least a portion of the user's captured vocal performance with the vocal score and, based on a threshold figure of merit, awarding the user a license or access to at least a portion of the vocal effects schedule. In some embodiments, the method includes transacting from the portable computing device an entitlement to recapture a selected portion of the vocal performance. In some embodiments, the method includes computationally evaluating correspondence of at least a portion of the user's captured vocal performance with the vocal score and based on a threshold figure of merit, according the user an entitlement to recapture a selected portion of the vocal performance.

In some embodiments in accordance with the present invention(s), a portable computing device includes a microphone interface, an audio transducer interface, a data communications interface, user interface code, pitch correction code and a rendering pipeline. The user interface code is executable on the portable computing device to capture user interface gestures selective for a backing track and to initiate retrieval of at least a vocal score corresponding thereto, the vocal score encoding a sequence of note targets for at least part of a vocal performance against the backing track. The user interface code is further executable to capture user interface gestures to initiate (i) audible rendering of the backing track, (ii) concurrent presentation of lyrics on a display (iii) capture of the user's vocal performance using the microphone interface and (iv) storage of a dry vocals version of the captured vocal performance to computer readable storage. The pitch correction code is executable on the portable computing device to, concurrent with said audible rendering, continuously and in real-time pitch correct the captured vocal performance in accord with the vocal score. The rendering pipeline executable to mix the user's pitch-corrected vocal performance into the audible rendering of the backing track against which the user's vocal performance is captured.

In some embodiments, the portable computing device includes the display. In some embodiments, the data communications interface provides a wireless interface to the display.

In some embodiments, the user interface code is further executable to capture user interface gestures indicative of a user selection of a vocal effects schedule and, responsive thereto, to transmit to a remote service or server via the data communications interface, an audio signal encoding of the dry vocals version of the user's captured vocal performance for the subsequent application, at the remote service or server, of the selected vocal effects schedule. In some cases, the transmission includes in, or for, association with the audio signal encoding of the dry vocals, an open call indication that the user's captured vocal performance constitutes but one of plural vocal performances to be combined at the remote service or server.

In some embodiments, the portable computing device includes code executable on the portable computing device evaluate correspondence of at least a portion of the user's captured vocal performance with the vocal score and based on a threshold figure of merit, to award the user a license or access to at least a portion of the vocal effects schedule. In some embodiments, the portable computing device includes code executable on the portable computing device evaluate correspondence of at least a portion of the user's captured vocal performance with the vocal score and based on a threshold figure of merit, to award the user an entitlement to recapture a selected portion of the vocal performance.

In some embodiments, the portable computing device further includes local storage, wherein the initiated retrieval includes checking instances, if any, of the vocal score information in the local storage against instances available from a remote server and retrieving from the remote server if instances in local storage are unavailable or out-of-date.

In some embodiments in accordance with the present invention(s), a computer program product encoded in one or more non-transitory media, the computer program product includes instructions executable on a processor of the portable computing device to cause the portable computing device to perform the steps one of the above-described methods.

These and other embodiments in accordance with the present invention(s) will be understood with reference to the description and appended claims which follow.

BRIEF DESCRIPTION OF THE DRAWINGS

The present invention is illustrated by way of example and not limitation with reference to the accompanying figures, in which like references generally indicate similar elements or features.

FIG. 6A illustrates content server-centric deployment of the signal processing architecture including interactions with a client application (e.g., portable computing device hosted) vocal capture platform. FIG. 6B analogously illustrates a client application-centric deployment (e.g., portable computing device hosted) of the signal processing architecture including interactions with a content server.

Figure 1:
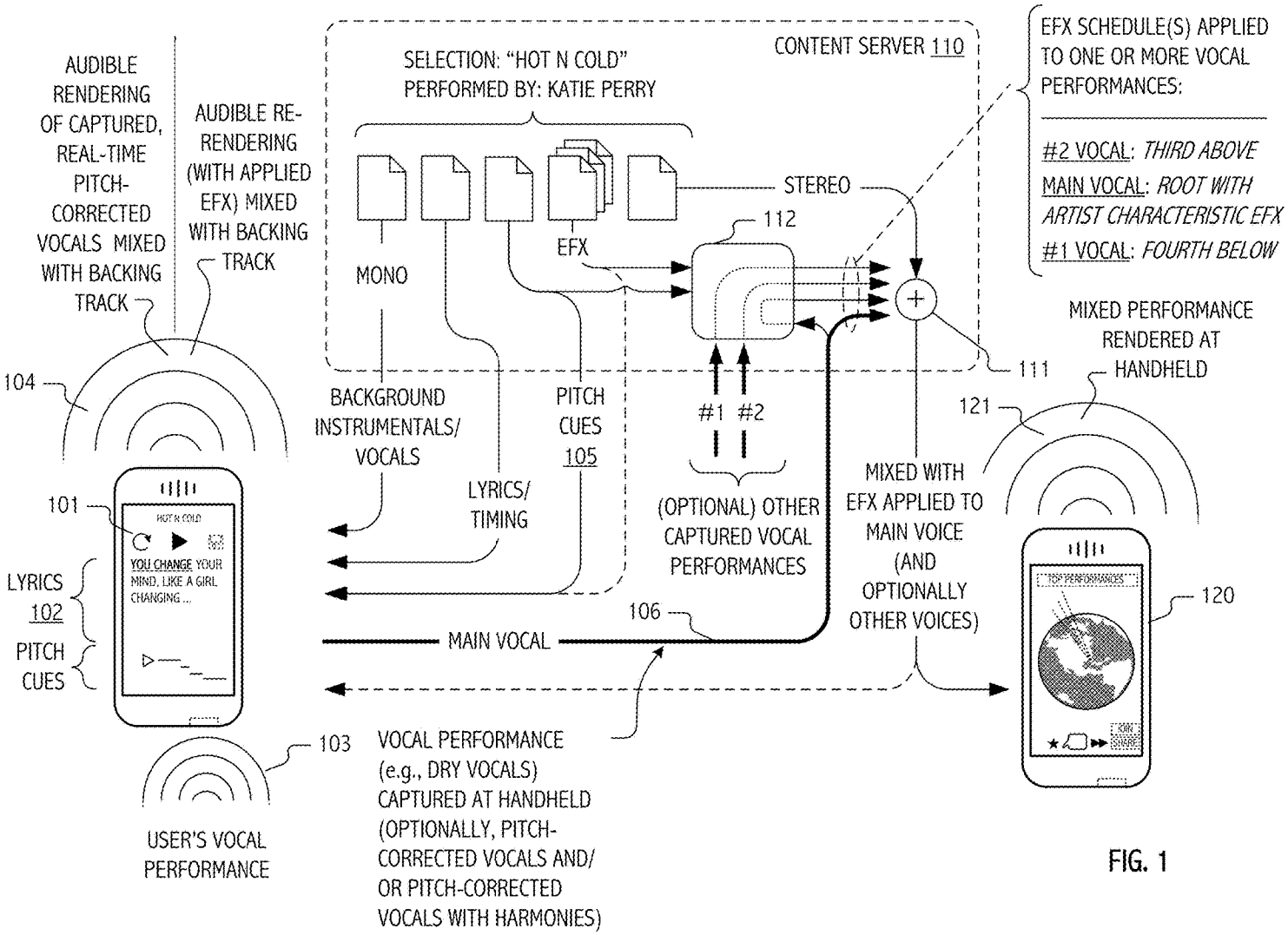
FIG. 1 depicts information flows amongst illustrative mobile phone-type portable computing devices and a content server in accordance with some embodiments of the present invention.

Skilled artisans will appreciate that elements or features in the figures are illustrated for simplicity and clarity and have not necessarily been drawn to scale. For example, the dimensions or prominence of some of the illustrated elements or features may be exaggerated relative to other elements or features in an effort to help to improve understanding of embodiments of the present invention.

DESCRIPTION

Techniques have been developed to facilitate the capture, pitch correction, harmonization, vocal effects (EFX) processing, encoding and audible rendering of vocal performances on handheld or other portable computing devices. Building on these techniques, mixes that include such vocal performances can be prepared for audible rendering on targets that include these handheld or portable computing devices as well as desktops, workstations, gaming stations and even telephony targets. Implementations of the described techniques employ signal processing techniques and allocations of system functionality that are suitable given the generally limited capabilities of such handheld or portable computing devices and that facilitate efficient encoding and communication of the pitch-corrected vocal performances (or precursors or derivatives thereof) via wireless and/or wired bandwidth-limited networks for rendering on portable computing devices or other targets.

Pitch detection and correction of a user's vocal performance are performed continuously and in real-time with respect to the audible rendering of the backing track at the handheld or portable computing device. In this way, pitch-corrected vocals may be mixed with the audible rendering to overlay (in real-time) the very instrumentals and/or vocals of the backing track against which the user's vocal performance is captured. In some implementations, pitch detection builds on time-domain pitch correction techniques that employ average magnitude difference function (AMDF) or autocorrelation-based techniques together with zero-crossing and/or peak picking techniques to identify differences between pitch of a captured vocal signal and score-coded target pitches. Based on detected differences, pitch correction based on pitch synchronous overlapped add (PSOLA) and/or linear predictive coding (LPC) techniques allow captured vocals to be pitch shifted in real-time to "correct" notes in accord with pitch correction settings that code score-coded melody targets and harmonies. Frequency domain techniques, such as FFT peak picking for pitch detection and phase vocoding for pitch shifting, may be used in some implementations, particularly when off-line processing is employed or computational facilities are substantially in excess of those typical of current generation mobile devices. Pitch detection and shifting (e.g., for pitch correction, harmonies and/or preparation of composite multi-vocalist, virtual glee club mixes) may also be performed in a post-processing mode.

In general, "correct" notes are those notes that are consistent with a specified key or scale or which, in some embodiments, correspond to a score-coded melody (or harmony) expected in accord with a particular point in the performance. That said, in a capella modes without an operant score (or that allow a user to, during vocal capture, dynamically vary pitch correction settings of an existing score) may be provided in some implementations to facilitate ad-libbing. For example, user interface gestures captured at the mobile phone (or other portable computing device) may, for particular lyrics, allow the user to (i) switch off (and on) use of score-coded note targets, (ii) dynamically switch back and forth between melody and harmony note sets as operant pitch correction settings and/or (iii) selectively fall back (at gesture selected points in the vocal capture) to settings that cause sounded pitches to be corrected solely to nearest notes of a particular key or scale (e.g., C major, C minor, E flat major, etc.) In short, user interface gesture capture and dynamically variable pitch correction settings can provide a Freestyle mode for advanced users.

In some cases, pitch correction settings may be selected to distort the captured vocal performance in accord with a desired effect, such as with pitch correction effects popularized by a particular musical performance or particular artist. In some embodiments, pitch correction may be based on techniques that computationally simplify autocorrelation calculations as applied to a variable window of samples from a captured vocal signal, such as with plug-in implementations of Auto-Tune® technology popularized by, and available from, Antares Audio Technologies.

Depending on the goals and implementation of a particular system, a user selectable vocal effects (EFX) schedule may include (in a computer readable media encoding) settings and/or parameters for one or more of spectral equalization, audio compression, pitch correction, stereo delay, and reverberation effects for application to one or more respective portions of the user's vocal performance. In some cases or embodiments, a vocal effects schedule may be characteristic of an artist, song or performance and may be applied to an audio encoding of the user's captured vocal performance to cause a derivative audio encoding or audible rendering to take on characteristics of the selected artist, song or performance.

Thus, one vocal effects schedule may, for example, be characteristic of a studio recording of lead vocals by the artist, Michael Jackson, performing "P.Y.T. (Pretty Young Thing)," while another may be characteristic of a cover version of the same song by the artist, T-Pain. In such case, a first vocal effects schedule (corresponding to the original performance by Michael Jackson) may encode in computer readable form EFX that (using in terminology often employed by studio engineers) includes bass roll-off, moderate compression, and digital plate reverb. More specifically, the first vocal effects schedule may encode parameters or settings of a 12 dB/octave high pass filter at 120 Hz, a tube compressor with 4:1 ratio and threshold of −10 dB, and a digital reverberator with warm plate setting, 30 ms pre-delay and 15% wet/dry mix. In contrast, a second vocal effects schedule (corresponding to the cover versions by T-Pain) may encode in computer readable form EFX that (again using in terminology often employed by studio engineers) includes high-pass equalization, pop compression, fast pitch correction, vocal doubling on some words, light reverb for "airiness." More specifically, the second vocal effects schedule may encode parameters or settings for a 24 dB/octave high pass filter at 200 Hz, digital compression with 4:1 ratio and threshold of −15 dB, pitch correction with 0 ms attack, stereo chorus, with a rate of 0.3 Hz, an intensity of 100% and mix of 100% (to emulate words that are doubled such as "pretty young thing" at particular score coded positions) and impulse-response-based reverb, for a concert hall with high-pass filtering at 300 Hz, length of 2.5 seconds, and 10% wet/dry mix.

Likewise, in some cases or embodiments, a vocal effects schedule may be characteristic of a particular musical genre. For example, one vocal effects schedule may be characteristic of a dance genre (e.g., encoding parameters or settings of a 24 dB/octave high pass filter at 250 Hz, a digital compressor with 6:1 ratio and threshold of −15 dB, a stereo delay with left channel [200 ms delay, 15% wet/dry mix, 40% feedback coefficient] and right channel [260 ms delay, 15% wet/dry mix, 40% feedback coefficient], and a digital reverberator with bright plate setting and 15% wet/dry mix), while another may be characteristic of a ballad genre (e.g., encoding parameters or settings of a 12 dB/octave high pass filter at 120 Hz, a digital compressor with 4:1 ratio and threshold of −8 dB, and a digital reverberator with large concert hall setting, 30 ms pre-delay and 20% wet/dry mix). Although particular parameterizations of musical genre-specific vocal effects schedules are, in general, implementation specific, based on the description herein, persons of skill in the art will appreciate suitable variations and other parameterizations of vocal effects schedules for these and other musical genres. Dance and ballad genres are merely illustrative.

It will be understood, that in the context of the present disclosure, the term vocal effects schedule is meant to encompass, in at least some cases or embodiments, an enumerated and operant set of vocal EFX to be applied to some or all of a captured (typically, dry vocals version of a) vocal performance. Thus, differing vocal effects schedules may be transacted and applied to captured dry vocals to provide a "Katy Perry effect" or a "T-Pain effect." Likewise, differing vocal effects schedules may be transacted and applied to captured dry vocals to imbue a derivative audio encoding or audible rendering with a musical genre-specific effect. In some cases, differing vocal effects schedules may be transacted and alternatively applied to a user's captured dry vocals to imbue a derivative audio encoding or audible rendering with studio or "live" performance characteristics. While, artist-, song- or performance-specific vocal EFX schedules are described separately from musical genre-specific vocal EFX schedules, it will be appreciated, that in some cases or embodiments, a particular vocal EFX schedule may conflate artist-, song-, performance-, and/or musical genre-specific aspects.

In at least some cases or embodiments, the term vocal effects schedule may further encompass, an enumerated set of vocal EFX that varies in temporal or template correspondence with portions of a vocal score (e.g., with distinct vocal EFX sets for pre-chorus and chorus portions of a song and/or with distinct vocal effects sets for respective portions of a duet or other multi-vocalist performance). Thus, in a vocal effects schedule for Cher's iconic performance of "Believe," certain score-aligned portions corresponding to pre-chorus sections of the performance may encode in computer readable form EFX that (using in terminology often employed by studio engineers) include spectral equalization, moderate compression, strong pitch correction, and light stereo delay, while portions corresponding to chorus sections of the performance may encode EFX that include bass roll-off, pop compression, long high-passed stereo delay, and rich/warm reverb. In more technical terms, pre-chorus section EFX in the vocal effects schedule may encode parameters or settings for a 24 dB/octave high pass filter at 400 Hz and a 12 dB/octave low pass filter at 2.2 kHz, a digital soft-knee compressor with 3:1 ratio and threshold of −10 dB, pitch correction with 0 ms attack, and a quarter-note synched delay on the left channel, offset by one eighth note on the right channel, both at 15% wet/dry mix and with feedback of 33%. In contrast, chorus section EFX in the vocal effects schedule may encode parameters or settings for a 12 dB/octave high pass filter at 120 Hz, a tube compressor with 4:1 ratio and threshold of −15 dB, half-note synced delay on the left channel, offset by 20 ms on the right channel, both at 25% wet/dry mix and with feedback of 45%, impulse-response-based reverberation characteristic of a concert hall with high-pass filtering at 200 Hz, length of 4.5 seconds and a 18% wet/dry mix.

Likewise, respective portions of a single vocal effects schedule (or for that matter, a pair of distinct vocal effects schedules) may be employed relative to respective vocal performance captures to provide appropriate and respective EFX for a vocal performance capture of a first portion of a duet performed by a first user and for a separate vocal performance capture of a second portion of a duet performed by a second user.

Based on the compelling and transformative nature of the pitch-corrected vocals and selectable vocal effects (EFX), user/vocalists typically overcome an otherwise natural shyness or angst associated with sharing their vocal performances. Instead, even mere amateurs are encouraged to share with friends and family or to collaborate and contribute vocal performances as part of an affinity group. In some implementations, these interactions are facilitated through social network- and/or eMail-mediated sharing of performances and invitations to join in a group performance or virtual glee club. Using uploaded vocals captured at clients such as the aforementioned portable computing devices, a content server (or service) can mediate such affinity groups by manipulating and mixing the uploaded vocal performances of multiple contributing vocalists. Depending on the goals and implementation of a particular system, uploads may include pitch-corrected vocal performances, dry (i.e., uncorrected) vocals, and/or control tracks of user key and/or pitch correction selections, etc.

Often, first and second encodings (often of differing quality or fidelity) of the same underlying audio source material may be employed. For example, use of first and second encodings of a backing track (e.g., one at the handheld or other portable computing device at which vocals are captured, and one at the content server) can allow the respective encodings to be adapted to data transfer bandwidth constraints or to needs at the particular device/platform at which they are employed. In some embodiments, a first encoding of the backing track audibly rendered at a handheld or other portable computing device as an audio backdrop to vocal capture may be of lesser quality or fidelity than a second encoding of that same backing track used at the content server to prepare the mixed performance for audible rendering. In this way, high quality mixed audio content may be provided while limiting data bandwidth requirements to a handheld device used for capture and pitch correction of a vocal performance.

Notwithstanding the foregoing, backing track encodings employed at the portable computing device may, in some cases, be of equivalent or even better quality/fidelity those at the content server. For example, in embodiments or situations in which a suitable encoding of the backing track already exists at the mobile phone (or other portable computing device), such as from a music library resident thereon or based on prior download from the content server, download data bandwidth requirements may be quite low. Lyrics, timing information and applicable pitch correction settings may be retrieved for association with the existing backing track using any of a variety of identifiers ascertainable, e.g., from audio metadata, track title, an associated thumbnail or even fingerprinting techniques applied to the audio, if desired.

Karaoke-Style Vocal Performance Capture

Although embodiments of the present invention are not necessarily limited thereto, mobile phone-hosted, pitch-corrected, karaoke-style, vocal capture provides a useful descriptive context. For example, in some embodiments such as illustrated in FIG. 1, an iPhone™ handheld available from Apple Inc. (or more generally, handheld 101) hosts software that executes in coordination with a content server to provide vocal capture and continuous real-time, score-coded pitch correction and harmonization of the captured vocals. As is typical of karaoke-style applications (such as the "I am T-Pain" application for iPhone originally released in September of 2009 or the later "Glee" application, both available from Smule, Inc.), a backing track of instrumentals and/or vocals can be audibly rendered for a user/vocalist to sing against. In such cases, lyrics may be displayed (102) in correspondence with the audible rendering so as to facilitate a karaoke-style vocal performance by a user. In some cases or situations, backing audio may be rendered from a local store such as from content of an iTunes™ library resident on the handheld.

User vocals 103 are captured at handheld 101, pitch-corrected continuously and in real-time (again at the handheld) and audibly rendered (see 104, mixed with the backing track) to provide the user with an improved tonal quality rendition of his/her own vocal performance. Pitch correction is typically based on score-coded note sets or cues (e.g., pitch and harmony cues 105), which provide continuous pitch-correction algorithms with performance synchronized sequences of target notes in a current key or scale. In addition to performance synchronized melody targets, score-coded harmony note sequences (or sets) provide pitch-shifting algorithms with additional targets (typically coded as offsets relative to a lead melody note track and typically scored only for selected portions thereof) for pitch-shifting to harmony versions of the user's own captured vocals. In some cases, pitch correction settings may be characteristic of a particular artist such as the artist that performed vocals associated with the particular backing track.

In the illustrated embodiment, backing audio (here, one or more instrumental and/or vocal tracks), lyrics and timing information and pitch/harmony cues are all supplied (or demand updated) from one or more content servers or hosted service platforms (here, content server 110). For a given song and performance, such as "Hot N Cold," several versions of the background track may be stored, e.g., on the content server. For example, in some implementations or deployments, versions may include:

uncompressed stereo wav format backing track,
uncompressed mono wav format backing track and
compressed mono m4a format backing track.

In addition, lyrics, melody and harmony track note sets and related timing and control information may be encapsulated as a score coded in an appropriate container or object (e.g., in a Musical Instrument Digital Interface, MIDI, or Java Script Object Notation, json, type format) for supply together with the backing track(s). Using such information, handheld 101 may display lyrics and even visual cues related to target notes, harmonies and currently detected vocal pitch in correspondence with an audible performance of the backing track(s) so as to facilitate a karaoke-style vocal performance by a user.

Thus, if an aspiring vocalist selects on the handheld device "Hot N Cold" as originally popularized by the artist Katy Perry, HotNCold.json and HotNCold.m4a may be downloaded from the content server (if not already available or cached based on prior download) and, in turn, used to provide background music, synchronized lyrics and, in some situations or embodiments, score-coded note tracks for continuous, real-time pitch-correction shifts while the user sings. Optionally, at least for certain embodiments or genres, harmony note tracks may be score coded for harmony shifts to captured vocals. Typically, a captured pitch-corrected (possibly harmonized) vocal performance is saved locally on the handheld device as one or more wav files and is subsequently compressed (e.g., using lossless Apple Lossless Encoder, ALE, or lossy Advanced Audio Coding, AAC, or vorbis codec) and encoded for upload (106) to content server 110 as an MPEG-4 audio, m4a, or ogg container file. MPEG-4 is an international standard for the coded representation and transmission of digital multimedia content for the Internet, mobile networks and advanced broadcast applications. OGG is an open standard container format often used in association with the vorbis audio format specification and codec for lossy audio compression. Other suitable codecs, compression techniques, coding formats and/or containers may be employed if desired.

Depending on the implementation, encodings of dry vocal and/or pitch-corrected vocals may be uploaded (106) to content server 110. In general, such vocals (encoded, e.g., as wav, m4a, ogg/vorbis content or otherwise) whether already pitch-corrected or pitch-corrected at content server 110 can then be mixed (111), e.g., with backing audio and other captured (and possibly pitch shifted) vocal performances, to produce files or streams of quality or coding characteristics selected accord with capabilities or limitations a particular target (e.g., handheld 120) or network. For example, pitch-corrected vocals can be mixed with both the stereo and mono wav files to produce streams of differing quality. In some cases, a high quality stereo version can be produced for web playback and a lower quality mono version for streaming to devices such as the handheld device itself.

As described elsewhere in herein, performances of multiple vocalists may be accreted in response to an open call. In some embodiments, one set of vocals (for example, in the illustration of FIG. 1, main vocals captured at handheld 101) may be accorded prominence (e.g., as lead vocals). In general, a user selectable vocal effects schedule may be applied (112) to each captured and uploaded encoding of a vocal performance. For example, initially captured dry vocals may be processed (e.g., 112) at content server 100 in accord with a vocal effects schedule characteristic of Katy Perry's studio performance of "Hot N Cold." In some cases or embodiments, processing may include pitch correction (at server 100) in accord with previously described pitch cues 105. In some embodiments, a resulting mix (e.g., pitch-corrected main vocals captured, with applied EFX and mixed with a compressed mono m4a format backing track and one or more additional vocals, themselves with applied EFX and pitch shifted into respective harmony positions above or below the main vocals) may be supplied to another user at a remote device (e.g., handheld 120) for audible rendering (121) and/or use as a second-generation backing track for capture of additional vocal performances.

Score-Coded Pitch Shifts and Vocal Effects Schedules

Figure 2:
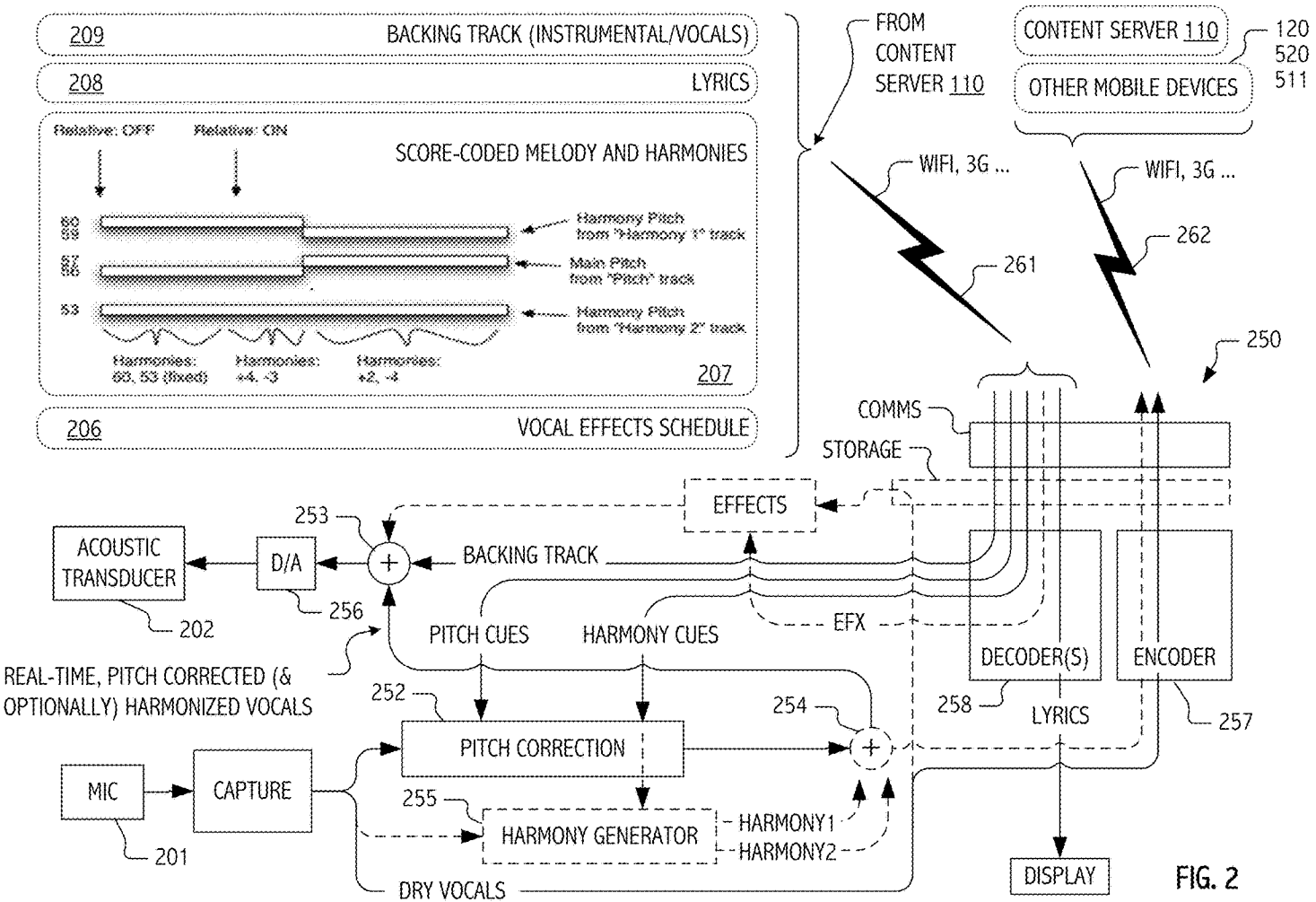
FIG. 2 is a flow diagram illustrating, for a captured vocal performance, real-time continuous pitch-correction and harmony generation based on score-coded pitch or harmony cues, together with storage and/or upload of a dry vocals version of the captured vocal performance for local and/or remote application of a vocal effects schedule in accordance with some embodiments of the present invention.

FIG. 2 is a flow diagram illustrating real-time continuous score-coded pitch-correction and/or harmony generation for a captured vocal performance in accordance with some embodiments of the present invention. As previously described as well as in the illustrated configuration, a user/vocalist sings along with a backing track karaoke style. Vocals captured (251) from a microphone input 201 are continuously pitch-corrected (252) to either main vocal pitch cues or, in some cases, to corresponding harmony cues in real-time for mix (253) with the backing track which is audibly rendered at one or more acoustic transducers 202. In some cases or embodiments, the audible rendering of captured vocals pitch corrected to "main" melody may optionally be mixed (254) with harmonies (HARMONY1, HARMONY2) synthesized from the captured vocals in accord with score coded offsets.

As will be apparent to persons of ordinary skill in the art, it is generally desirable to limit feedback loops from transducer(s) 202 to microphone 201 (e.g., through the use of head- or earphones). Indeed, while much of the illustrative description herein builds upon features and capabilities that are familiar in mobile phone contexts and, in particular, relative to the Apple iPhone handheld, even portable computing devices without a built-in microphone capabilities may act as a platform for vocal capture with continuous, real-time pitch correction and harmonization if headphone/microphone jacks are provided. The Apple iPod Touch handheld and the Apple iPad tablet are two such examples.

Both pitch correction (to main or harmony pitches) and optionally added harmonies are chosen to correspond to a score 207, which in the illustrated configuration, is wirelessly communicated (261) to the device (e.g., from content server 110 to an iPhone handheld 101 or other portable computing device, recall FIG. 1) on which vocal capture and pitch-correction is to be performed, together with lyrics 208 and an audio encoding of the backing track 209. One challenge faced in some designs and implementations is that harmonies may have a tendency to sound good only if the user chooses to sing the expected melody of the song. If a user wants to embellish or sing their own version of a song, harmonies may sound suboptimal. To address this challenge, relative harmonies are pre-scored and coded for particular content (e.g., for a particular song and selected portions thereof). Target pitches chosen at runtime for harmonies based both on the score and what the user is singing. This approach has resulted in a compelling user experience.

In some embodiments of techniques described herein, we determine from our score the note (in a current scale or key) that is closest to that sounded by the user/vocalist. While this closest note may typically be a main pitch corresponding to the score-coded vocal melody, it need not be. Indeed, in some cases, the user/vocalist may intend to sing harmony and sounded notes may more closely approximate a harmony track. In either case, pitch corrector 252 and/or harmony generator 255 may synthesize the other portions of the desired score-coded chord by generating appropriate pitch-shifted versions of the captured vocals (even if user/vocalist is intentionally singing a harmony). A dry vocals version of the user's captured vocal performance and, optionally, one or more of the resulting pitch-shifted versions combined (254) or aggregated for mix (253) with the audibly-rendered backing track may be wirelessly communicated (262) to content server 110 or a remote device (e.g., handheld 120).

Although content server 100 side application of vocal effects has been described, it will be appreciated that user selectable vocal effects (EFX) schedules may likewise be applied in signal processing flows 250 implemented at a portable computing device (e.g., 101, 120). As before, a selected vocal effects (EFX) schedule, which in the present case may be encoded and included in wireless transmission 261, includes settings and/or parameters for one or more of spectral equalization, audio compression, pitch correction, stereo delay, and reverberation effects for application to one or more respective portions of the user's captured vocal performance. In the illustrated configuration, an optional signal processing flow is provided for an audio signal encoding of dry vocals stored in local storage and the mixed (253) with a previously described backing track for audible rendering using acoustic transducer 202. Typically, application of a user selected vocal effects (EFX) schedule at the portable computing device is a post-processing application although, depending on the nature and computational of complexity of EFX selected, real-time continuous procession (including score coded pitch correction) may be provided in some embodiments.

Although persons of ordinary skill in the art will recognize that any of a variety of score-coding frameworks may be employed, exemplary implementations described herein build on extensions to widely-used and standardized musical instrument digital interface (MIDI) data formats. Building on that framework, scores may be coded as a set of tracks represented in a MIDI file, data structure or container including, in some implementations or deployments:

- a control track: key changes, gain changes, pitch correction controls, harmony controls, etc.
- one or more lyrics tracks: lyric events, with display customizations
- a pitch track: main melody (conventionally coded)
- one or more harmony tracks: harmony voice 1, 2 . . . . Depending on control track events, notes specified in a given harmony track may be interpreted as absolute scored pitches or relative to user's current pitch, corrected or uncorrected (depending on current settings).
- a chord track: although desired harmonies are set in the harmony tracks, if the user's pitch differs from scored pitch, relative offsets may be maintained by proximity to the note set of a current chord.

Building on the forgoing, significant score-coded specializations can be defined to establish run-time behaviors of pitch corrector 252 and/or harmony generator 255 and thereby provide a user experience and pitch-corrected vocals that (for a wide range of vocal skill levels) exceed that achievable with conventional static harmonies.

Turning specifically to control track features, in some embodiments, the following text markers may be supported:

- Key: <string>: Notates key (e.g., G sharp major, g#M, E minor, Em, B flat Major, BbM, etc.) to which sounded notes are corrected. Default to C.
- PitchCorrection: {ON, OFF}: Codes whether to correct the user/vocalist's pitch. Default is ON. May be turned ON and OFF at temporally synchronized points in the vocal performance.
- SwapHarmony: {ON, OFF}: Codes whether, if the pitch sounded by the user/vocalist corresponds most closely to a harmony, it is okay to pitch correct to harmony, rather than melody. Default is ON.
- Relative: {ON, OFF}: When ON, harmony tracks are interpreted as relative offsets from the user's current pitch (corrected in accord with other pitch correction settings). Offsets from the harmony tracks are their offsets relative to the scored pitch track. When OFF, harmony tracks are interpreted as absolute pitch targets for harmony shifts.
- Relative: {OFF, <+/−N> . . . <+/−N>}: Unless OFF, harmony offsets (as many as you like) are relative to the scored pitch track, subject to any operant key or note sets.
- RealTimeHarmonyMix: {value}: codes changes in mix ratio, at temporally synchronized points in the vocal performance, of main voice and harmonies in audibly rendered harmony/main vocal mix. 1.0 is all harmony voices. 0.0 is all main voice.
- RecordedHarmonyMix: {value}: codes changes in mix ratio, at temporally synchronized points in the vocal performance, of main voice and harmonies in uploaded harmony/main vocal mix. 1.0 is all harmony voices. 0.0 is all main voice.

Chord track events, in some embodiments, include the following text markers that notate a root and quality (e.g., C min7 or Ab maj) and allow a note set to be defined. Although desired harmonies are set in the harmony track(s), if the user's pitch differs from the scored pitch, relative offsets may be maintained by proximity to notes that are in the current chord. As used relative to a chord track of the score, the term "chord" will be understood to mean a set of available pitches, since chord track events need not encode standard chords in the usual sense. These and other score-coded pitch correction settings may be employed furtherance of the inventive techniques described herein.

Computational Techniques for Pitch Detection, Correction and Shifts

Figure 3:
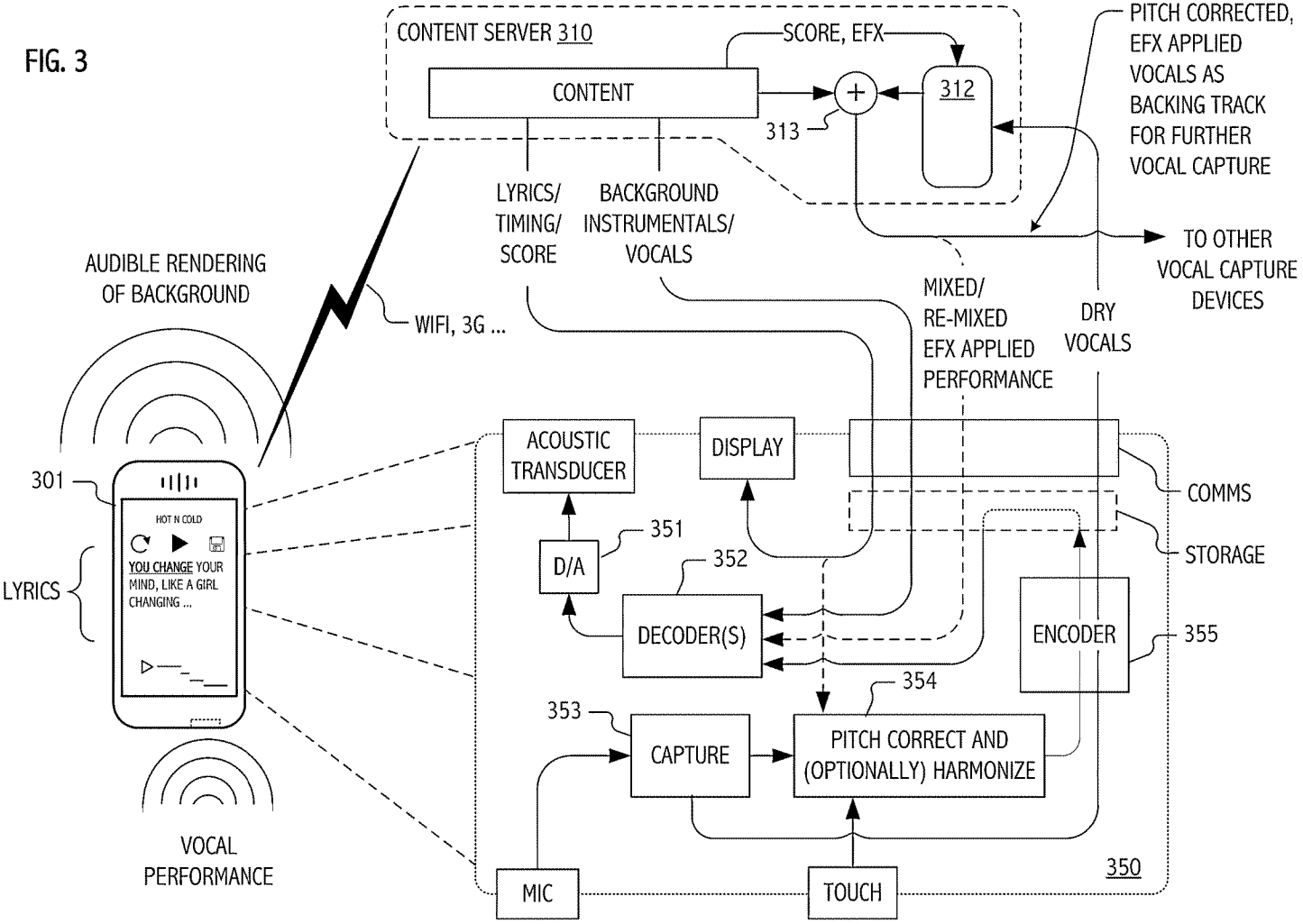
FIG. 3 is a functional block diagram of hardware and software components executable at an illustrative mobile phone-type portable computing device to facilitate real-time continuous pitch-correction and transmission of dry vocals for application, at a remote content server, of a vocal effects schedule in accordance with some embodiments of the present invention.

As will be appreciated by persons of ordinary skill in the art having benefit of the present description, pitch-detection and correction techniques may be employed both for correction of a captured vocal signal to a target pitch or note and for generation of harmonies as pitch-shifted variants of a captured vocal signal. FIGS. 2 and 3 illustrate basic signal processing flows (250, 350) in accord with certain implementations suitable for an iPhone™ handheld, e.g., that illustrated as mobile device 101, to generate pitch-corrected and optionally harmonized vocals for audible rendering (locally and/or at a remote target device).

Based on the description herein, persons of ordinary skill in the art will appreciate suitable allocations of signal processing techniques (sampling, filtering, decimation, etc.) and data representations to functional blocks (e.g., decoder(s) 352, digital-to-analog (D/A) converter 351, capture 253 and encoder 355) of a software executable to provide signal processing flows 350 illustrated in FIG. 3. Likewise, relative to the signal processing flows 250 and illustrative score coded note targets (including harmony note targets), persons of ordinary skill in the art will appreciate suitable allocations of signal processing techniques and data representations to functional blocks and signal processing constructs (e.g., decoder(s) 258, capture 251, digital-to-analog (D/A) converter 256, mixers 253, 254, and encoder 257) as in FIG. 2, implemented at least in part as software executable on a handheld or other portable computing device.

Building then on any of a variety of suitable implementations of the forgoing signal processing constructs, we turn to pitch detection and correction/shifting techniques that may be employed in the various embodiments described herein, including in furtherance of the pitch correction, harmony generation and combined pitch correction/harmonization blocks (252, 255 and 354) illustrated in FIGS. 2 and 3.

As will be appreciated by persons of ordinary skill in the art, pitch-detection and pitch-correction have a rich technological history in the music and voice coding arts. Indeed, a wide variety of feature picking, time-domain and even frequency-domain techniques have been employed in the art and may be employed in some embodiments in accord with the present invention. The present description does not seek to exhaustively inventory the wide variety of signal processing techniques that may be suitable in various design or implementations in accord with the present description; rather, we summarize certain techniques that have proved workable in implementations (such as mobile device applications) that contend with CPU-limited computational platforms.

Accordingly, in view of the above and without limitation, certain exemplary embodiments operate as follows:

1) Get a buffer of audio data containing the sampled user vocals.
2) Downsample from a 44.1 kHz sample rate by low-pass filtering and decimation to 22 k (for use in pitch detection and correction of sampled vocals as a main voice, typically to score-coded melody note target) and to 11 k (for pitch detection and shifting of harmony variants of the sampled vocals).
3) Call a pitch detector (PitchDetector::CalculatePitch( )), which first checks to see if the sampled audio signal is of sufficient amplitude and if that sampled audio isn't too noisy (excessive zero crossings) to proceed. If the sampled audio is acceptable, the CalculatePitch( )method calculates an average magnitude difference function (AMDF) and executes logic to pick a peak that corresponds to an estimate of the pitch period. Additional processing refines that estimate. For example, in some embodiments parabolic interpolation of the peak and adjacent samples may be employed. In some embodiments and given adequate computational bandwidth, an additional AMDF may be run at a higher sample rate around the peak sample to get better frequency resolution.
4) Shift the main voice to a score-coded target pitch by using a pitch-synchronous overlap add (PSOLA) technique at a 22 kHz sample rate (for higher quality and overlap accuracy). The PSOLA implementation (Smola::PitchShiftVoice( )) is called with data structures and Class variables that contain information (detected pitch, pitch target, etc.) needed to specify the desired correction. In general, target pitch is selected based on score-coded targets (which change frequently in correspondence with a melody note track) and in accord with current scale/mode settings. Scale/mode settings may be updated in the course of a particular vocal performance, but usually not too often based on score-coded information, or in an a capella or Freestyle mode based on user selections.

PSOLA techniques facilitate resampling of a waveform to produce a pitch-shifted variant while reducing aperiodic affects of a splice and are well known in the art. PSOLA techniques build on the observation that it is possible to splice two periodic waveforms at similar points in their periodic oscillation (for example, at positive going zero crossings, ideally with roughly the same slope) with a much smoother result if you cross fade between them during a segment of overlap. For example, if we had a quasi periodic sequence like:

| a | b | c | d | e | d | c | b | a | b | c | d.1 | e.2 | d.2 | c.1 | b.1 | a | b.1 | c.2 |
|---|---|---|---|---|---|---|---|---|---|---|---|---|---|---|---|---|---|---|
| 0 | 1 | 2 | 3 | 4 | 5 | 6 | 7 | 8 | 9 | 10 | 11 | 12 | 13 | 14 | 15 | 16 | 17 | 18 |

with samples {a, b, c, . . . } and indices 0, 1, 2, . . . (wherein the 0.1 symbology represents deviations from periodicity) and wanted to jump back or forward somewhere, we might pick the positive going c-d transitions at indices 2 and 10, and instead of just jumping, ramp:

$$(1*c+0*c),\ (d*7/8+(d.1)/8),\ (e*6/8+(e.2)*2/8)$$

until we reached (0*c+1*c.1) at index 10/18, having jumped forward a period (8 indices) but made the aperiodicity less evident at the edit point. It is pitch synchronous because we do it at 8 samples, the closest period to what we can detect. Note that the cross-fade is a linear/triangular overlap-add, but (more generally) may employ complimentary cosine, 1-cosine, or other functions as desired.
5) Generate the harmony voices using a method that employs both PSOLA and linear predictive coding (LPC) techniques. The harmony notes are selected based on the current settings, which change often according to the score-coded harmony targets, or which in Freestyle can be changed by the user. These are target pitches as described above; however, given the generally larger pitch shift for harmonies, a different technique may be employed. The main voice (now at 22 k, or optionally 44 k) is pitch-corrected to target using PSOLA techniques such as described above. Pitch shifts to respective harmonies are likewise performed using PSOLA techniques. Then a linear predictive coding (LPC) is applied to each to generate a residue signal for each harmony. LPC is applied to the main un-pitch-corrected voice at 11 k (or optionally 22 k) in order to derive a spectral template to apply to the pitch-shifted residues. This tends to avoid the head-size modulation problem (chipmunk or munchkinification for upward shifts, or making people sound like Darth Vader for downward shifts).
6) Finally, the residues are mixed together and used to re-synthesize the respective pitch-shifted harmonies using the filter defined by LPC coefficients derived for the main un-pitch-corrected voice signal. The resulting mix of pitch-shifted harmonies are then mixed with the pitch-corrected main voice.
7) Resulting mix is upsampled back up to 44.1 k, mixed with the backing track (except in Freestyle mode) or an improved fidelity variant thereof buffered for handoff to audio subsystem for playback.

As will be appreciated by persons of skill in the art, AMDF calculations are but one time-domain computational technique suitable for measuring periodicity of a signal. More generally, the term lag-domain periodogram describes a function that takes as input, a time-domain function or series of discrete time samples x(n) of a signal, and compares that function or signal to itself at a series of delays (i.e., in the lag-domain) to measure periodicity of the original function x. This is done at lags of interest.

Therefore, relative to the techniques described herein, examples of suitable lag-domain periodogram computations for pitch detection include subtracting, for a current block, the captured vocal input signal x(n) from a lagged version of same (a difference function), or taking the absolute value of that subtraction (AMDF), or multiplying the signal by its delayed version and summing the values (autocorrelation).

AMDF will show valleys at periods that correspond to frequency components of the input signal, while autocorrelation will show peaks. If the signal is non-periodic (e.g., noise), periodograms will show no clear peaks or valleys, except at the zero lag position. Mathematically, $$\mathrm{AMDF}(k)=\Sigma_n|x(n)-x(n-k)|$$

$$\mathrm{autocorrelation}(k)=\Sigma_n x(n)*x(n-k).$$

For implementations described herein, AMDF-based lag-domain periodogram calculations can be efficiently performed even using computational facilities of current-generation mobile devices. Nonetheless, based on the description herein, persons of skill in the art will appreciate implementations that build any of a variety of pitch detection techniques that may now, or in the future become, computational tractable on a given target device or platform.

Accretion of Vocal Performances in Response to an "Open Call"

Once a vocal performance is captured at the handheld device, the captured vocal performance audio (typically dry vocals, but optionally pitch corrected) is compressed using an audio codec (e.g., an Advanced Audio Coding (AAC) or ogg/vorbis codec) and uploaded to a content server. FIGS. 1, 2 and 3 each depict such uploads. In general, the content server (e.g., content server 110, 310) then processes (112, 312) the uploaded dry vocals in accord with a selected vocal effects (EFX) schedule and applicable score-coded pitch correction sets. The content server then remixes (111, 311) this captured, pitch-corrected, EFX applied vocal performance encoding with other content. For example, the content server may mix such vocals with a high-quality or fidelity instrumental (and/or background vocal) track to create high-fidelity master audio of the mixed performance. Other captured vocal performances may also be mixed in as illustrated in FIG. 1 and described herein.

In general, the resulting master may, in turn, be encoded using an appropriate codec (e.g., an AAC codec) at various bit rates and/or with selected vocals afforded prominence to produce compressed audio files which are suitable for streaming back to the capturing handheld device (and/or other remote devices) and for streaming/playback via the web. In general, relative to capabilities of commonly deployed wireless networks, it can be desirable from an audio data bandwidth perspective to limit the uploaded data to that necessary to represent the vocal performance, while mixing when and where needed. In some cases, data streamed for playback or for use as a second (or $N^{th}$) generation backing track may separately encode vocal tracks for mix with a first generation backing track at an audible rendering target. In general, vocal and/or backing track audio exchange between the handheld device and content server may be adapted to the quality and capabilities of an available data communications channel.

Relative to certain social network constructs that, in some embodiments of the present invention, facilitate open call handling, additional or alternative mixes may be desirable. For example, in some embodiments, an accretion of pitch-corrected, EFX applied vocals captured from an initial, or prior, contributor may form the basis of a backing track used in a subsequent vocal capture from another user/vocalist (e.g., at another handheld device). Accordingly, where supply and use of backing tracks is illustrated and described herein, it will be understood, that vocals captured, pitch-corrected, EFX applied (and possibly, though not typically, harmonized) may themselves be mixed to produce a "backing track" used to motivate, guide or frame subsequent vocal capture.

In general, additional vocalists may be invited to sing a particular part (e.g., tenor, part B in duet, etc.) or simply to sign, whereupon content server 110 may pitch shift and place their captured vocals into one or more positions within an open call or virtual glee club. Typically, the user-vocalist who initiated an open call selects the slots or positions (characterized temporally or by performance template/blueprint, by applicable pitch cues and/or applied EFX) into which subsequently accreted vocal performances are slotted or placed. Although mixed vocals may be included in such a backing track, it will be understood that because the illustrated and described systems separately capture and apply vocal effects schedules and pitch-correct individual vocal performances, the content server (e.g., content server 110) is in position to manipulate (112) mixes in ways that further objectives of a virtual glee club or accommodate sensibilities of the user vocalist who initiates an open call.

For example, in some embodiments of the present invention, alternative mixes of three different contributing vocalists may be presented in a variety of ways. Mixes provided to (or for) a first contributor may feature that first contributor's vocals more prominently than those of the other two (e.g., as lead vocals with appropriate pitch correction to main melody and with an artist-, song-, performance- or musical genre-specific vocal effects (EFX) schedule applied). In general, content server 110 may alter the mixes to make one vocal performance more prominent than others by manipulating pitch corrections and EFX applied to the various captured vocals therein.

World Stage

Although much of the description herein has focused on vocal performance capture, pitch correction and use of respective first and second encodings of a backing track relative to capture and mix of a user's own vocal performances, it will be understood that facilities for audible rendering of remotely captured performances of others may be provided in some situations or embodiments. In such situations or embodiments, vocal performance capture occurs at another device and after a corresponding encoding of the captured (and typically pitch-corrected) vocal performance is received at a present device, it is audibly rendered in association with a visual display animation suggestive of the vocal performance emanating from a particular location on a globe. FIG. 1 illustrates a snapshot of such a visual display animation at handheld 120, which for purposes of the present illustration, will be understood as another instance of a programmed mobile phone (or other portable computing device) such as described and illustrated with reference to handheld device instances 101 and 301 (see FIG. 3), except that (as depicted with the snapshot) handheld 120 is operating in a play (or listener) mode, rather than the capture and pitch-correction mode described at length hereinabove.

When a user executes the handheld application and accesses this play (or listener) mode, a world stage is presented. More specifically, a network connection is made to content server 110 reporting the handheld's current network connectivity status and playback preference (e.g., random global, top loved, my performances, etc). Based on these parameters, content server 110 selects a performance (e.g., a pitch-corrected, EFX applied vocal performance such as may have been initially captured at handheld device instance 101 or 301 and transmits metadata associated therewith. In some implementations, the metadata includes a uniform resource locator (URL) that allows handheld 120 to retrieve the actual audio stream (high quality or low quality depending on the size of the pipe), as well as additional information such as geocoded (using GPS) location of the vocal performance capture (including geocodes for additional vocal performances included as harmonies or backup vocals) and attributes of other listeners who have loved, tagged or left comments for the particular performance. In some embodiments, listener feedback is itself geocoded. During playback, the user may tag the performance and leave his own feedback or comments for a subsequent listener and/or for the original vocal performer. Once a performance is tagged, a relationship may be established between the performer and the listener. In some cases, the listener may be allowed to filter for additional performances by the same performer and the server is also able to more intelligently provide "random" new performances for the user to listen to based on an evaluation of user preferences.

Although not specifically illustrated in the snapshot, it will be appreciated that geocoded listener feedback indications are, or may optionally be, presented on the globe (e.g., as stars or "thumbs up" or the like) at positions to suggest, consistent with the geocoded metadata, respective geographic locations from which the corresponding listener feedback was transmitted. It will be further appreciated that, in some embodiments, the visual display animation is interactive and subject to viewpoint manipulation in correspondence with user interface gestures captured at a touch screen display of handheld 120. For example, in some embodiments, travel of a finger or stylus across a displayed image of the globe in the visual display animation causes the globe to rotate around an axis generally orthogonal to the direction of finger or stylus travel. Both the visual display animation suggestive of the vocal performance emanating from a particular location on a globe and the listener feedback indications are presented in such an interactive, rotating globe user interface presentation at positions consistent with their respective geotags.

An Exemplary Mobile Device

Figure 4:
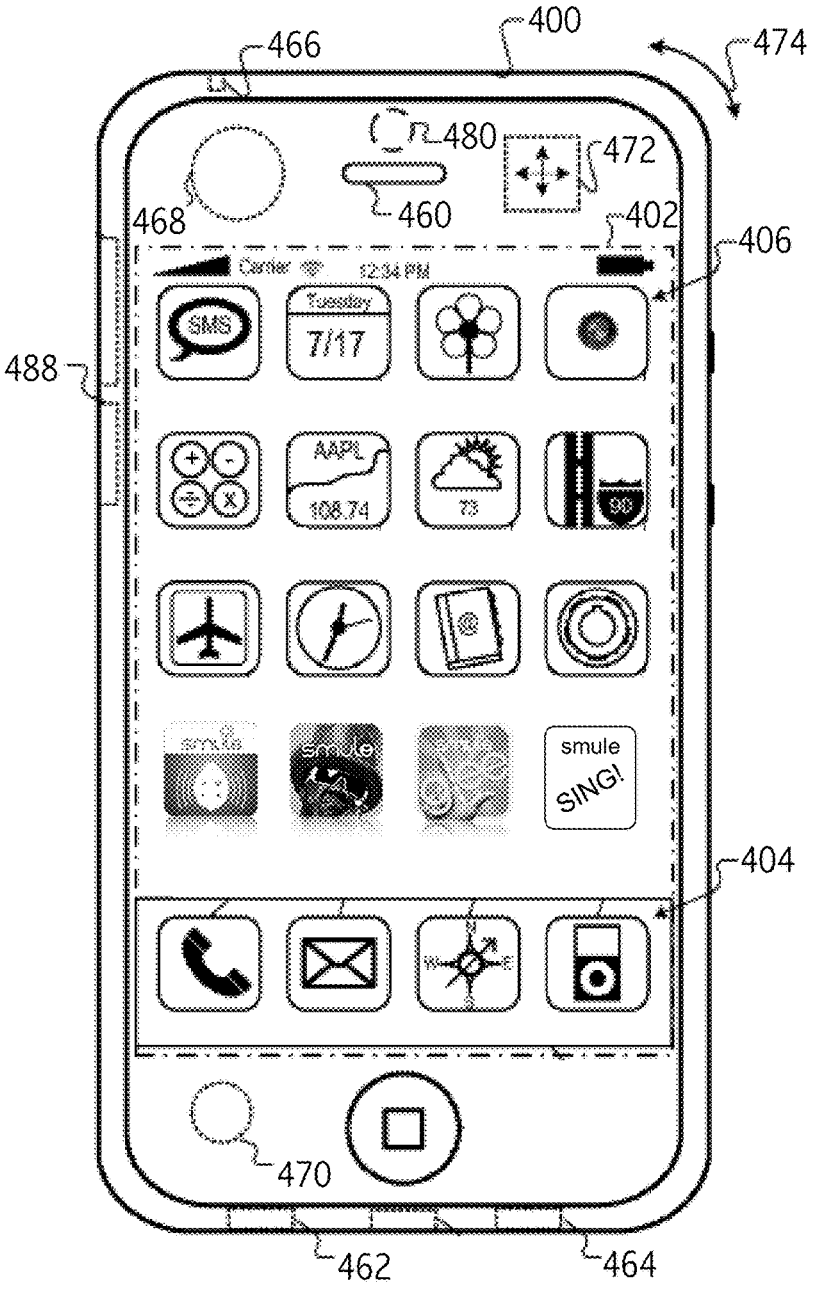
FIG. 4 illustrates features of a mobile device that may serve as a platform for execution of software implementations in accordance with some embodiments of the present invention.

FIG. 4 illustrates features of a mobile device that may serve as a platform for execution of software implementations in accordance with some embodiments of the present invention. More specifically, FIG. 4 is a block diagram of a mobile device 400 that is generally consistent with commercially-available versions of an iPhone™ mobile digital device. Although embodiments of the present invention are certainly not limited to iPhone deployments or applications (or even to iPhone-type devices), the iPhone device, together with its rich complement of sensors, multimedia facilities, application programmer interfaces and wireless application delivery model, provides a highly capable platform on which to deploy certain implementations. Based on the description herein, persons of ordinary skill in the art will appreciate a wide range of additional mobile device platforms that may be suitable (now or hereafter) for a given implementation or deployment of the inventive techniques described herein.

Summarizing briefly, mobile device 400 includes a display 402 that can be sensitive to haptic and/or tactile contact with a user. Touch-sensitive display 402 can support multi-touch features, processing multiple simultaneous touch points, including processing data related to the pressure, degree and/or position of each touch point. Such processing facilitates gestures and interactions with multiple fingers, chording, and other interactions. Of course, other touch-sensitive display technologies can also be used, e.g., a display in which contact is made using a stylus or other pointing device.

Typically, mobile device 400 presents a graphical user interface on the touch-sensitive display 402, providing the user access to various system objects and for conveying information. In some implementations, the graphical user interface can include one or more display objects 404, 406. In the example shown, the display objects 404, 406, are graphic representations of system objects. Examples of system objects include device functions, applications, windows, files, alerts, events, or other identifiable system objects. In some embodiments of the present invention, applications, when executed, provide at least some of the digital acoustic functionality described herein.

Typically, the mobile device 400 supports network connectivity including, for example, both mobile radio and wireless internetworking functionality to enable the user to travel with the mobile device 400 and its associated network-enabled functions. In some cases, the mobile device 400 can interact with other devices in the vicinity (e.g., via Wi-Fi, Bluetooth, etc.). For example, mobile device 400 can be configured to interact with peers or a base station for one or more devices. As such, mobile device 400 may grant or deny network access to other wireless devices.

Mobile device 400 includes a variety of input/output (I/O) devices, sensors and transducers. For example, a speaker 460 and a microphone 462 are typically included to facilitate audio, such as the capture of vocal performances and audible rendering of backing tracks and mixed pitch-corrected vocal performances as described elsewhere herein. In some embodiments of the present invention, speaker 460 and microphone 662 may provide appropriate transducers for techniques described herein. An external speaker port 464 can be included to facilitate hands-free voice functionalities, such as speaker phone functions. An audio jack 466 can also be included for use of headphones and/or a microphone. In some embodiments, an external speaker and/or microphone may be used as a transducer for the techniques described herein.

Other sensors can also be used or provided. A proximity sensor 468 can be included to facilitate the detection of user positioning of mobile device 400. In some implementations, an ambient light sensor 470 can be utilized to facilitate adjusting brightness of the touch-sensitive display 402. An accelerometer 472 can be utilized to detect movement of mobile device 400, as indicated by the directional arrow 474. Accordingly, display objects and/or media can be presented according to a detected orientation, e.g., portrait or landscape. In some implementations, mobile device 400 may include circuitry and sensors for supporting a location determining capability, such as that provided by the global positioning system (GPS) or other positioning systems (e.g., systems using Wi-Fi access points, television signals, cellular grids, Uniform Resource Locators (URLs)) to facilitate geocodings described herein. Mobile device 400 can also include a camera lens and sensor 480. In some implementations, the camera lens and sensor 480 can be located on the back surface of the mobile device 400. The camera can capture still images and/or video for association with captured pitch-corrected vocals.

Mobile device 400 can also include one or more wireless communication subsystems, such as an 802.11b/g communication device, and/or a Bluetooth™ communication device 488. Other communication protocols can also be supported, including other 802.x communication protocols (e.g., WiMax, Wi-Fi, 3G), code division multiple access (CDMA), global system for mobile communications (GSM), Enhanced Data GSM Environment (EDGE), etc. A port device 490, e.g., a Universal Serial Bus (USB) port, or a docking port, or some other wired port connection, can be included and used to establish a wired connection to other computing devices, such as other communication devices 400, network access devices, a personal computer, a printer, or other processing devices capable of receiving and/or transmitting data. Port device 490 may also allow mobile device 400 to synchronize with a host device using one or more protocols, such as, for example, the TCP/IP, HTTP, UDP and any other known protocol.

Figure 5:
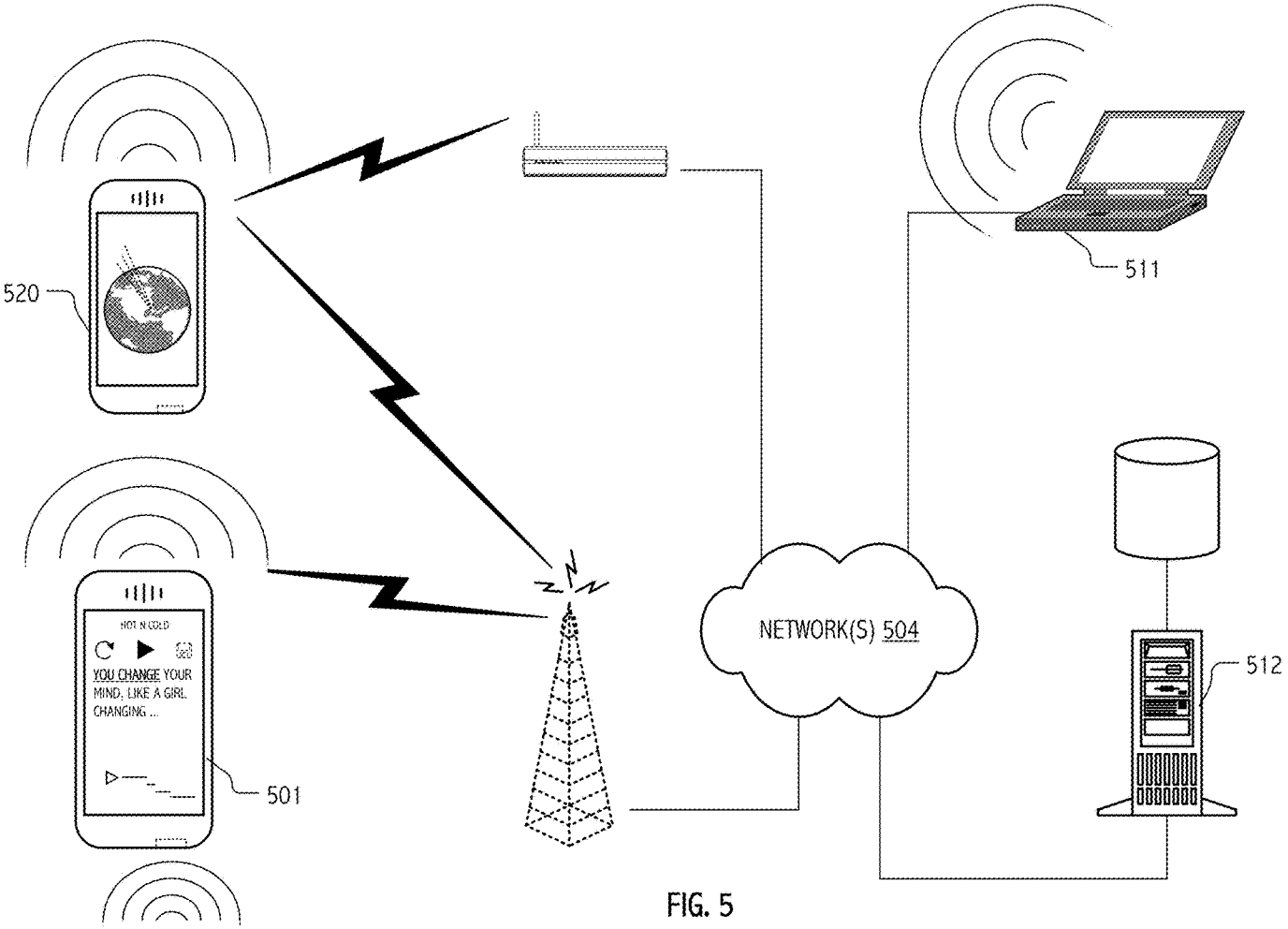
FIG. 5 is a network diagram that illustrates cooperation of exemplary devices in accordance with some embodiments of the present invention.
Figure 6A:
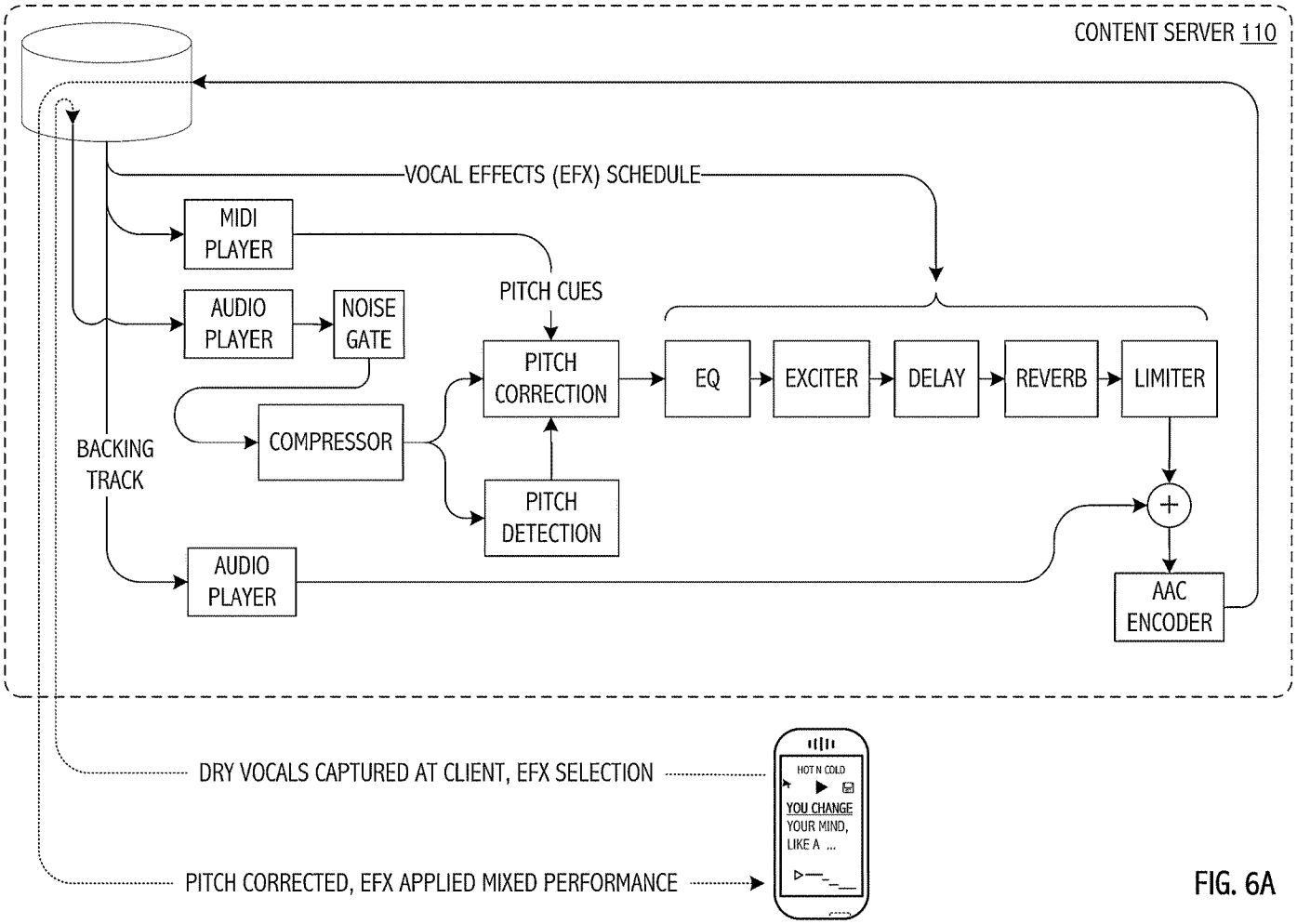
FIGS. 6A and 6B present, in flow diagrammatic form, complementary (and in some cases cooperative) deployments of a signal processing architecture for application of a vocal effects schedule in accordance with respective and illustrative embodiments of the present invention. Specifically.
Figure 6B:
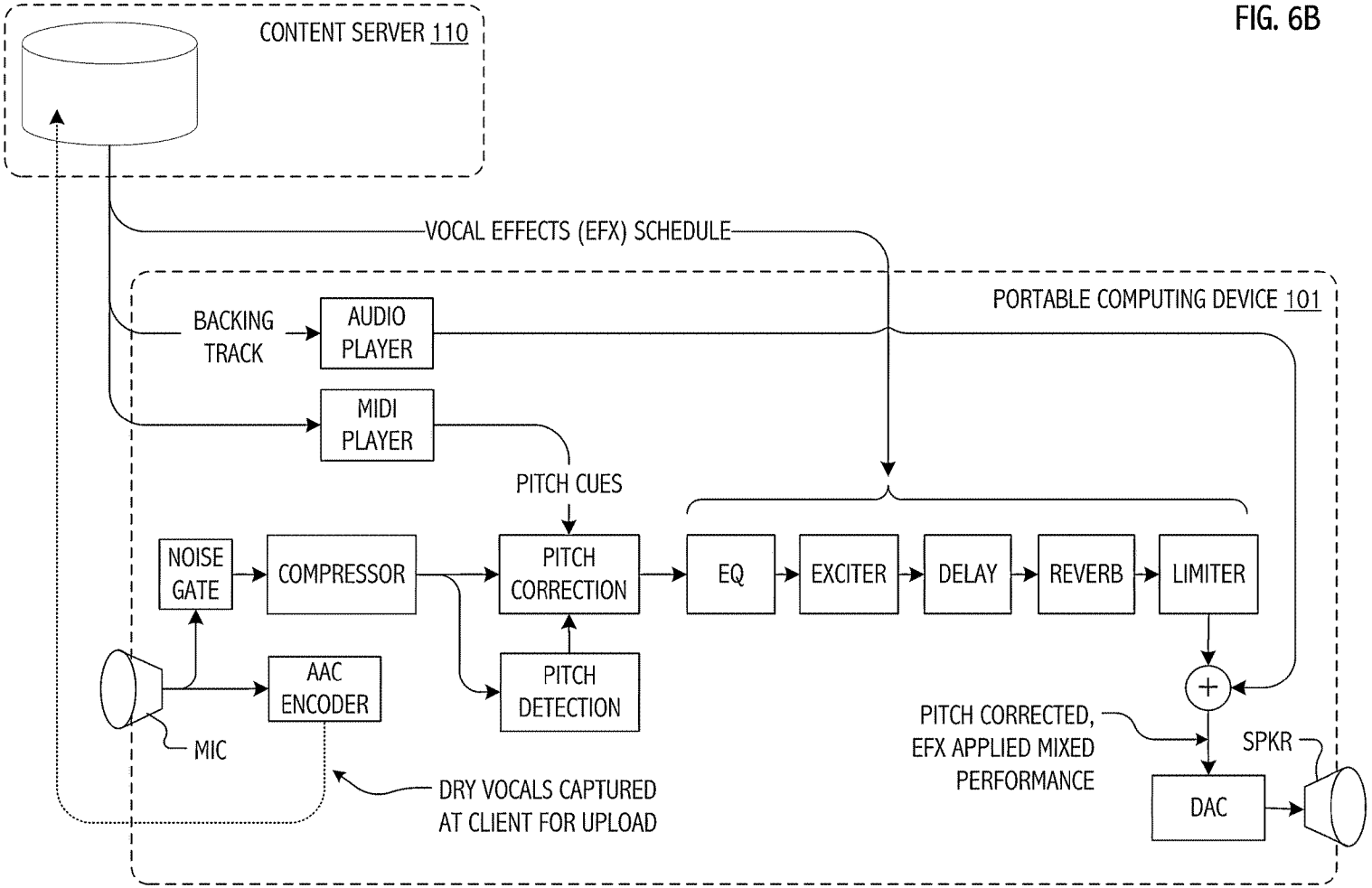

FIG. 5 illustrates respective instances (501 and 520) of a portable computing device such as mobile device 400 programmed with user interface code, pitch correction code, an audio rendering pipeline and playback code in accord with the functional descriptions herein. Device instance 501 operates in a vocal capture and continuous pitch correction mode, while device instance 520 operates in a listener mode. Both communicate via wireless data transport and intervening networks 504 with a server 512 or service platform that hosts storage and/or functionality explained herein with regard to content server 110, 210. Captured, pitch-corrected vocal performances may (optionally) be streamed from and audibly rendered at laptop computer 511.

Other Embodiments

While the invention(s) is (are) described with reference to various embodiments, it will be understood that these embodiments are illustrative and that the scope of the invention(s) is not limited to them. Many variations, modifications, additions, and improvements are possible. For example, while pitch correction vocal performances captured in accord with a karaoke-style interface have been described, other variations will be appreciated. Furthermore, while certain illustrative signal processing techniques have been described in the context of certain illustrative applications, persons of ordinary skill in the art will recognize that it is straightforward to modify the described techniques to accommodate other suitable signal processing techniques and effects.

Embodiments in accordance with the present invention may take the form of, and/or be provided as, a computer program product encoded in a machine-readable medium as instruction sequences and other functional constructs of software, which may in turn be executed in a computational system (such as a iPhone handheld, mobile or portable computing device, or content server platform) to perform methods described herein. In general, a machine readable medium can include tangible articles that encode information in a form (e.g., as applications, source or object code, functionally descriptive information, etc.) readable by a machine (e.g., a computer, computational facilities of a mobile device or portable computing device, etc.) as well as tangible storage incident to transmission of the information. A machine-readable medium may include, but is not limited to, magnetic storage medium (e.g., disks and/or tape storage); optical storage medium (e.g., CD-ROM, DVD, etc.); magneto-optical storage medium; read only memory (ROM); random access memory (RAM); erasable programmable memory (e.g., EPROM and EEPROM); flash memory; or other types of medium suitable for storing electronic instructions, operation sequences, functionally descriptive information encodings, etc.

In general, plural instances may be provided for components, operations or structures described herein as a single instance. Boundaries between various components, operations and data stores are somewhat arbitrary, and particular operations are illustrated in the context of specific illustrative configurations. Other allocations of functionality are envisioned and may fall within the scope of the invention(s). In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the invention(s).

What is claimed is:

1. A method comprising:

using a portable computing device for vocal performance capture, the portable computing device having a touch screen, a microphone interface and a communications interface;

responsive to a user selection on the touch screen, retrieving via the communications interface, a vocal score temporally synchronized with a corresponding backing track and lyrics, the vocal score encoding a sequence of target notes for at least part of a vocal performance of the user against the backing track;

at the portable computing device, audibly rendering the backing track and concurrently presenting corresponding portions of the lyrics on a display in temporal correspondence therewith;

capturing via the microphone interface, and in temporal correspondence with the backing track, the vocal performance of the user;

applying at least one vocal effects schedule to the user's captured vocal performance; and computationally evaluating correspondence of at least a portion of the user's captured vocal performance with the vocal score to generate an evaluation result and, based on a threshold figure of merit and the evaluation result, awarding the user a license or access to at least a locked portion of the vocal effects schedule.

2. The method of claim 1, wherein the vocal effects schedule includes a computer readable encoding of settings and/or parameters for one or more of spectral equalization, audio compression, pitch correction, stereo delay, and reverberation effects, for application to one or more respective portions of the user's vocal performance.

3. The method of claim 2, wherein the vocal effects schedule codes differing effects for application to respective portions of the user's vocal performance in temporal correspondence with the backing track or lyrics.

4. The method of claim 2, wherein the vocal effects schedule is characteristic of a particular musical genre.

5. The method of claim 2, wherein the vocal effects schedule is characteristic of a particular artist, song or performance.

6. The method of claim 2, further comprising:

transacting from the portable computing device a purchase or license of at least a portion of the vocal effects schedule.

7. The method of claim 6, further comprising:

in furtherance of the transacting, retrieving via the communications interface, or unlocking a preexisting stored instance of, a computer readable encoding of the vocal effects schedule.

8. The method of claim 2, wherein the vocal effects schedule is subsequently applied to a dry vocals version of the user's captured vocal performance.

9. The method of claim 2, wherein in accord with the vocal score, the portable computing device performs continuous, real-time pitch shifting of at least some portion of the user's captured vocal performance and mixes the resulting pitch-shifted vocal performance of the user with into the audible rendering of the backing track;

wherein the vocal effects schedule is applied at the portable computing device in a rendering pipeline that includes the continuous, real-time pitch shifting such that the audible rendering includes vocal effects included in the vocal effects schedule.

10. A method comprising:

using a portable computing device for vocal performance capture, the portable computing device having a touch screen, a microphone interface and a communications interface;

responsive to a user selection on the touch screen, retrieving via the communications interface, a vocal score temporally synchronized with a corresponding backing track and lyrics, the vocal score encoding a sequence of target notes for at least part of a vocal performance of the user against the backing track;

at the portable computing device, audibly rendering the backing track and concurrently presenting corresponding portions of the lyrics on a display in temporal correspondence therewith;

capturing via the microphone interface, and in temporal correspondence with the backing track, the vocal performance of the user;

applying at least one vocal effects schedule to the user's captured vocal performance, wherein the vocal effects schedule includes a computer readable encoding of settings and/or parameters for one or more of spectral equalization, audio compression, pitch correction, stereo delay, and reverberation effects, for application to one or more respective portions of the user's vocal performance;

computationally evaluating correspondence of at least a portion of the user's captured vocal performance with the vocal score to generate an evaluation result and, based on a threshold figure of merit and the evaluation result, awarding the user a license or access to at least a locked portion of the vocal effects schedule; and subsequently applying the vocal effects schedule to a dry vocals version of the user's captured vocal performance at the portable computing device; and audibly re-rendering at the portable computing device the user's captured vocal performance with pitch shifting and vocal effects applied.

11. A method comprising:

using a portable computing device for vocal performance capture, the portable computing device having a touch screen, a microphone interface and a communications interface;

responsive to a user selection on the touch screen, retrieving via the communications interface, a vocal score temporally synchronized with a corresponding backing track and lyrics, the vocal score encoding a sequence of target notes for at least part of a vocal performance of the user against the backing track;

at the portable computing device, audibly rendering the backing track and concurrently presenting corresponding portions of the lyrics on a display in temporal correspondence therewith;

capturing via the microphone interface, and in temporal correspondence with the backing track, the vocal performance of the user;

applying at least one vocal effects schedule to the user's captured vocal performance, wherein the vocal effects schedule includes a computer readable encoding of settings and/or parameters for one or more of spectral equalization, audio compression, pitch correction, stereo delay, and reverberation effects, for application to one or more respective portions of the user's vocal performance;

computationally evaluating correspondence of at least a portion of the user's captured vocal performance with the vocal score to generate an evaluation result and, based on a threshold figure of merit and the evaluation result, awarding the user a license or access to at least a locked portion of the vocal effects schedule;

subsequently applying the vocal effects schedule to a dry vocals version of the user's captured vocal performance;

transmitting to a remote service or server, via the communications interface, an audio signal encoding of the dry vocals version of the user's captured vocal performance for the subsequent application, at the remote service or server, of the vocal effects schedule.

12. The method of claim 11, further comprising:

transmitting in, or for, association with the transmitted audio signal encoding of the dry vocals version, an open call indication that the user's captured vocal performance constitutes but one of plural vocal performances to be combined at the remote service or server.

13. The method of claim 12, wherein the open call indication directs the remote service or server to solicit from one or more other vocalists the additional one or more vocal performances to be mixed for audible rendering with that of the user.

14. The method of claim 13, wherein the solicitation is directed to one or more of:

an enumerated set of potential other vocalists specified by the user;

members of an affinity group defined or recognized by the remote service or server; and a set of social network relations of the user.

15. The method of claim 12, wherein the open call indication specifies for at least one additional vocalist position, a second vocal score and second lyrics for supply to a responding additional vocalist.

16. The method of claim 15, wherein the open call indication further specifies for the at least one additional vocalist position, a second vocal effects schedule for application to the vocal performance of the responding additional vocalist.

17. The method of claim 12, further comprising:

geocoding the transmitted audio signal encoding of the dry vocals version.

18. The method of claim 17, further comprising:

receiving from the remote service or server via the communications interface an audio signal encoding that includes a second vocal performance captured at a remote device; and displaying a geographic origin for the second vocal performance in correspondence with an audible rendering that includes the second vocal performance.

19. The method of claim 18, wherein the display of geographic origin is by display animation suggestive of a performance emanating from a particular location on a globe.

20. The method of claim 11, further comprising:

receiving from the remote service or server a version of the user's captured vocal performance processed in accordance with the vocal effects schedule; and audibly re-rendering at the portable computing device the user's captured vocal performance with vocal effects applied.

21. A method, comprising:

using a portable computing device for vocal performance capture, the portable computing device having a touch screen, a microphone interface and a communications interface;

responsive to a user selection on the touch screen, retrieving via the communications interface, a vocal score temporally synchronized with a corresponding backing track and lyrics, the vocal score encoding a sequence of target notes for at least part of a vocal performance of the user against the backing track;

at the portable computing device, audibly rendering the backing track and concurrently presenting corresponding portions of the lyrics on a display in temporal correspondence therewith;

capturing via the microphone interface, and in temporal correspondence with the backing track, the vocal performance of the user; and transacting from the portable computing device an entitlement to initiate vocal recapture of a user selected portion of the captured vocal performance.

22. The method of claim 21, further comprising:

computationally evaluating correspondence of at least a portion of the user's captured vocal performance with the vocal score to generate an evaluation result and based on a threshold figure of merit and the evaluation result, according the user the entitlement to initiate vocal recapture of the user selected portion of the captured vocal performance.

23. The method of claim 21, further comprising:

storing at the portable computing device a dry vocals version of the user's captured vocal performance, wherein in accord with the vocal score, the portable computing device performs continuous, real-time pitch shifting of at least some portion of the user's captured vocal performance and mixes the resulting pitch-shifted vocal performance of the user with the audible rendering of the backing track, wherein the pitch shifting is based on continuous time-domain estimation of pitch for the user's captured vocal performance.

24. The method of claim 23, wherein the continuous time-domain pitch estimation includes computing, for a current block of a sampled signal corresponding to the user's captured vocal performance, a lag-domain periodogram, the lag-domain periodogram computation includes, for an analysis window of the sampled signal, evaluation of an average magnitude difference function (AMDF) or an autocorrelation function for a range of lags.

25. The method of claim 21, further comprising:

responsive to the user selection, also retrieving the backing track via the data communications interface.

26. The method of claim 21, wherein the backing track resides in storage local to the portable computing device, and wherein the retrieving identifies the vocal score temporally synchronizable with the corresponding backing track and lyrics using an identifier ascertainable from the locally stored backing track.

27. The method of claim 21, wherein the backing track includes either or both of instrumentals and backing vocals and is rendered in multiple versions;

wherein a first version of the backing track audibly rendered in correspondence with the lyrics is a monophonic scratch version, and a second version of the backing track mixed with pitch-corrected vocal versions of the user's vocal performance is a polyphonic version of higher quality or fidelity than the scratch version.

28. The method of claim 21, wherein the portable computing device is selected from the group of:

a mobile phone;

a personal digital assistant;

a media player or gaming device; and a laptop computer, notebook computer, tablet computer or net book.

29. The method of claim 21, wherein the display includes the touch screen.

30. The method of claim 21, wherein the display is wirelessly coupled to the portable computing device.

31. A method comprising:

using a portable computing device for vocal performance capture, the portable computing device having a touch screen, a microphone interface and a communications interface;

responsive to a user selection on the touch screen, retrieving via the communications interface, a vocal score temporally synchronized with a corresponding backing track and lyrics, the vocal score encoding a sequence of target notes for at least part of a vocal performance against the backing track;

at the portable computing device, audibly rendering the backing track and concurrently presenting corresponding portions of the lyrics on a display in temporal correspondence therewith;

capturing via the microphone interface, and in temporal correspondence with the backing track, a vocal performance of the user;

transmitting to a remote service or server, via the communications interface, an audio signal encoding of the user's captured vocal performance together with a selection of at least one vocal effects schedule to be applied to the user's captured vocal performance by the remote service or server; and transacting from the portable computing device an entitlement to recapture a selected portion of the vocal performance.

32. The method of claim 31, further comprising:

applying, at the remote service or server, the selected vocal effects schedule.

33. The method of claim 31, further comprising:

at the portable computing device and in accord with the vocal score, performing continuous, real-time pitch shifting of at least some portions of the user's captured vocal performance and mixing the resulting pitch-shifted vocal performance of the user into the audible rendering of the backing track.

34. The method of claim 31, wherein the selected vocal effects schedule includes a computer readable encoding of settings and/or parameters for one or more of spectral equalization, audio compression, pitch correction, stereo delay, and reverberation effects, for application to one or more respective portions of the user's vocal performance.

35. The method of claim 31, wherein the vocal effects schedule is characteristic of a particular artist, song or performance.

36. The method of claim 31, wherein the vocal effects schedule is characteristic of a particular musical genre.

37. The method of claim 31, further comprising:

transacting from the portable computing device a purchase or license of at least a portion of the vocal effects schedule.

38. The method of claim 31, further comprising:

computationally evaluating correspondence of at least a portion of the user's captured vocal performance with the vocal score to generate an evaluation result and, based on a threshold figure of merit and the evaluation result, awarding the user a license or access to at least a locked portion of the vocal effects schedule.

39. The method of claim 31, further comprising:

computationally evaluating correspondence of at least a portion of the user's captured vocal performance with the vocal score to generate an evaluation result and based on a threshold figure of merit and the evaluation result, according the user an entitlement to recapture a selected portion of the vocal performance.

40. A portable computing device comprising:

a microphone interface; an audio transducer interface; a data communications interface;

user interface code executable on the portable computing device to capture user interface gestures selective for a backing track and to initiate retrieval of at least a vocal score corresponding thereto, the vocal score encoding a sequence of note targets for at least part of a vocal performance against the backing track;

the user interface code further executable to capture user interface gestures to initiate (i) audible rendering of the backing track, (ii) concurrent presentation of lyrics on a display, and (iii) capture of the user's vocal performance using the microphone interface; and evaluate correspondence of at least a portion of the user's captured vocal performance with the vocal score to generate a first evaluation result and based on a first threshold figure of merit and the first evaluation result, award the user an entitlement to recapture a selected portion of the vocal performance.

41. The portable computing device of claim 40, further comprising:

a rendering pipeline executable to mix the user's pitch-corrected vocal performance with the audible rendering of the backing track against which the user's vocal performance is captured;

wherein the rendering pipeline is further executable to apply vocal effects schedules to the user's captured vocal performance, the vocal effects schedules selectable by the user and including a computer readable encoding of settings and/or parameters for one or more of spectral equalization, audio compression, pitch correction, stereo delay, and reverberation effects, for application to one or more respective portions of the user's vocal performance.

42. The portable computing device of claim 40, further comprising:

the display.

43. The portable computing device of claim 40, wherein the data communications interface provides a wireless interface to the display.

44. The portable computing device of claim 40, the user interface code further executable to capture user interface gestures indicative of a user selection of a vocal effects schedule and, responsive thereto, to transmit to a remote service or server via the data communications interface, an audio signal encoding of the dry vocals version of the user's captured vocal performance for the subsequent application, at the remote service or server, of the selected vocal effects schedule.

45. The portable computing device of claim 44, wherein the transmission includes in, or for, association with the audio signal encoding of the dry vocals version, an open call indication that the user's captured vocal performance constitutes but one of plural vocal performances to be combined at the remote service or server.

46. The portable computing device of claim 40, further comprising:

code executable on the portable computing device to evaluate correspondence of at least a portion of the user's captured vocal performance with the vocal score to generate a second evaluation result, and based on a second threshold figure of merit and the second evaluation result, to award the user a license or access to at least a locked portion of the vocal effects schedule.

47. The portable computing device of claim 40, further comprising local storage, wherein the initiated retrieval includes checking instances, if any, of the vocal score information in the local storage against instances available from a remote server and retrieving from the remote server if instances in local storage are unavailable or out-of-date.

48. A computer program product encoded in one or more non-transitory media, the computer program product including instructions executable on a processor of a portable computing device to cause the portable computing device to perform the steps of claim 1.

49. A computer program product encoded in one or more non-transitory media, the computer program product including instructions executable on a processor of a portable computing device to cause the portable computing device to perform the steps of claim 31.

* * * * *